US008251489B2

(12) United States Patent
Kayahara et al.

(10) Patent No.: US 8,251,489 B2
(45) Date of Patent: Aug. 28, 2012

(54) LIQUID EJECTING DEVICE

(75) Inventors: Naoki Kayahara, Chino (JP); Toru Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 882 days.

(21) Appl. No.: 12/315,223

(22) Filed: Dec. 1, 2008

(65) Prior Publication Data

US 2009/0141078 A1 Jun. 4, 2009

(30) Foreign Application Priority Data

Nov. 29, 2007 (JP) ..... 2007-309259
Jun. 13, 2008 (JP) ..... 2008-155704

(51) Int. Cl.
*B41J 2/155* (2006.01)

(52) U.S. Cl. ..... 347/42; 347/47

(58) Field of Classification Search ..... 347/42, 347/41

See application file for complete search history.

(56) References Cited

U.S. PATENT DOCUMENTS

| | | | |
|---|---|---|---|
| 6,328,418 | B1 | 12/2001 | Yamada et al. |
| 2002/0008731 | A1 | 1/2002 | Matsumoto et al. |
| 2005/0168503 | A1 | 8/2005 | Mitsuzawa |

FOREIGN PATENT DOCUMENTS

| | | | |
|---|---|---|---|
| EP | 0340960 | A1 | 11/1989 |
| EP | 0693380 | A1 | 1/1996 |
| EP | 1642727 | A2 | 4/2006 |
| EP | 1705014 | A2 | 9/2006 |
| EP | 1795354 | A2 | 6/2007 |
| JP | 08-025635 | | 1/1996 |
| JP | 2003-127352 | | 5/2003 |
| JP | 2004-122546 | | 4/2004 |
| JP | 2005-199692 | | 7/2005 |
| JP | 2006-264152 | | 10/2006 |
| JP | 2006-346575 | | 12/2006 |

OTHER PUBLICATIONS

European Search Report dated Nov. 13, 2009 issued in the corresponding EP Application No. 08170296.1.

*Primary Examiner* — Jerry Rahll
(74) *Attorney, Agent, or Firm* — Nutter McClennen & Fish LLP; John J. Penny, Jr.; Derek P. Roller

(57) ABSTRACT

A liquid ejecting device includes a head unit having a first nozzle array and a second nozzle array that ejects a liquid of a same type as that of the first nozzle array and a movement mechanism that moves at least one between a target in which the liquid lands and the head unit in a movement direction that intersects with a direction of nozzle arrangement of each of the nozzle arrays. The second nozzle array is disposed in a position deviated from the first nozzle array in the movement direction and is disposed in a position deviated from the first nozzle array in the intersection direction such that an end part of the second nozzle array is located in a center part of the first nozzle array in the intersection direction that intersects with the movement direction.

10 Claims, 17 Drawing Sheets

LIQUID EJECTING DEVICE

BACKGROUND

1. Technical Field

The present invention relates to a liquid ejecting device.

2. Related Art

As liquid ejecting devices, there are printers employing an ink jet type. The printer employing the ink jet method, for example, has a head unit that ejects ink as a liquid from nozzle arrays and a movement mechanism that moves a paper sheet as a landing target in which ink lands in a predetermined movement direction. In this printer, by ejecting ink from the head unit in accordance with the position of the paper sheet in the direction of paper movement, the ejected ink lands in the paper sheet.

In the above-described printer, when ink is ejected from the nozzle arrays, a phenomenon of ejection amount variances in which the amount of ejected ink deviates from a target ejection amount may occur in both end parts of the nozzle arrays. When ink is ejected in a state that the above-described phenomenon of ejection amount variances occurs, landing fluctuations in which the sizes of dots on the paper sheet become irregular in accordance with the variances of the ejection amount are generated. Thus, in order to avoid the above-described landing fluctuations, technology for deviating nozzle arrays that eject liquids of different types in a perpendicular direction that is perpendicular to the direction of paper movement has been proposed (for example, see JP-A-2006-346575).

However, in this technology, end parts of nozzle arrays that eject liquids of a same type are disposed to be overlapped with one another in the above-described perpendicular direction. Thus, when ink is ejected from nozzles located in the overlapped range, the landing fluctuations appear to be overlapped on the paper sheet, and accordingly, the landing fluctuations become visually distinctive.

SUMMARY

An advantage of some aspects of the invention is that it provides a liquid ejecting device capable of suppressing the visual distinctiveness of the landing fluctuations.

According to a main aspect of the invention, there is provided a liquid ejecting device including: a head unit having a first nozzle array and a second nozzle array that ejects a liquid of a same type as that of the first nozzle array; and a movement mechanism that moves at least one between a target in which the liquid lands and the head unit in a movement direction that intersects with a direction of nozzle arrangement of each of the nozzle arrays. The second nozzle array is disposed in a position deviated from the first nozzle array in the movement direction and is disposed in a position deviated from the first nozzle array in the intersection direction such that an end part of the second nozzle array is located in a center part of the first nozzle array in the intersection direction that intersects with the movement direction.

Other aspects of the invention will become apparent by descriptions below and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
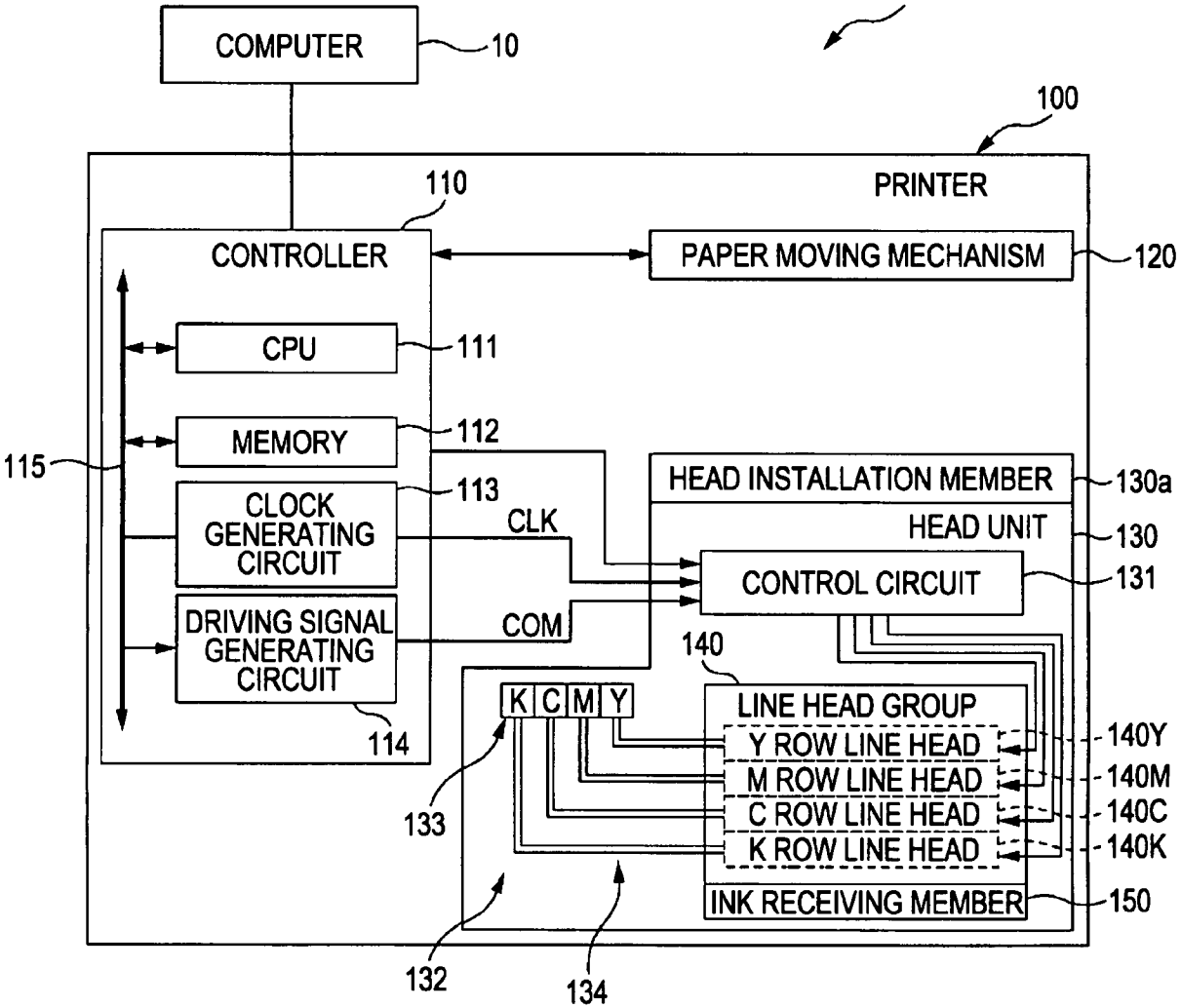
FIG. 1 is a schematic block diagram showing the configuration of a printing system including a printer according to a first embodiment of the invention.

By descriptions here and accompanying drawings, at least the following aspects become apparent.

According to a first aspect of the invention, there is provided a liquid ejecting device including: a head unit having a first nozzle array and a second nozzle array that ejects a liquid of a same type as that of the first nozzle array; and a movement mechanism that moves at least one between a target in which the liquid lands and the head unit in a movement direction that intersects with a direction of nozzle arrangement of each of the nozzle arrays. The second nozzle array is disposed in a position deviated from the first nozzle array in the movement direction and is disposed in a position deviated from the first nozzle array in the intersection direction such that an end part of the second nozzle array is located in a center part of the first nozzle array in the intersection direction that intersects with the movement direction.

According to the above-described liquid ejecting device, the end part of the second nozzle array is located in the center part of the first nozzle array in the intersection direction. As a result, even when the phenomenon of ejection amount variances due to the first nozzle array and the second nozzle array occurs, the landing fluctuations due to the phenomenon of ejection amount variations in both the nozzle arrays cannot be easily overlapped with one another in the intersection direction. In other words, the landing fluctuations are dispersed in the intersection direction. Accordingly, visual distinctiveness of the landing fluctuations can be suppressed.

According to a second aspect of the invention, there is provided a liquid ejecting device including: a head unit having a plurality of nozzle arrays; and a movement mechanism that moves at least one between a target in which the liquid lands and the head unit in a movement direction that intersects with a direction of nozzle arrangement of each of the nozzle arrays. The plurality of nozzle arrays has a set of n nozzle arrays including a first nozzle array and at least one second nozzle array that ejects a liquid of a same type as that of the first nozzle array and is disposed in a position deviated from the first nozzle array in the movement direction and an intersection direction that intersects with the movement direction such that an end part of the second nozzle array is disposed between one end of the first nozzle array and the other end, and the second nozzle array is in a position deviated from the first nozzle array in the intersection direction such that the end part of the second nozzle array is apart from a corresponding end part of the first nozzle array by a distance determined by 1/n of the length of the first nozzle array.

According to the above-described liquid ejecting device, in the n nozzle arrays forming one set, the end part of the first nozzle array and the end part of the second nozzle array are apart by a distance determined by 1/n of the length of the first nozzle array. As a result, even when the phenomenon of ejection amount variances due to the first nozzle array and the second nozzle array occurs, the landing fluctuations due to the phenomenon of ejection amount variations in both the nozzle arrays cannot be easily overlapped with one another in the intersection direction. In other words, the landing fluctuations are dispersed in the intersection direction. Accordingly, visual distinctiveness of the landing fluctuations can be suppressed.

According to a third aspect of the invention, there is provided a liquid ejecting device including: a head unit having a first nozzle array and a second nozzle array that ejects a liquid of a same type as that of the first nozzle array; and a movement mechanism that moves at least one between a target in which the liquid lands and the head unit in a movement direction that intersects with a direction of nozzle arrangement of each of the nozzle arrays. The second nozzle array is disposed in a position deviated from the first nozzle array in the movement direction and is disposed in a position deviated from the first nozzle array in an intersection direction, which intersects with the movement direction, such that a center of the second nozzle array is apart from a center of the first nozzle array by a distance of a half of the length of the first nozzle array in the intersection direction.

According to the above-described liquid ejecting device, the center of the second nozzle array is apart from the center of the first nozzle array by a half of the length of the first nozzle array. As a result, even when the phenomenon of ejection amount variances due to the first nozzle array and the second nozzle array occurs, the landing fluctuations due to the phenomenon of ejection amount variations in both the nozzle arrays cannot be easily overlapped with each other in the intersection direction. Accordingly, visual distinctiveness of the landing fluctuations can be suppressed.

According to a fourth aspect of the invention, there is provided a liquid ejecting device including: a head unit having a plurality of nozzle arrays; and a movement mechanism that moves at least one between a target in which the liquid lands and the head unit in a movement direction that intersects with a direction of nozzle arrangement of each of the nozzle arrays. The plurality of nozzle arrays has a set of n nozzle arrays including a first nozzle array and at least one second nozzle array that ejects a liquid of a same type as that of the first nozzle array and is disposed in a position deviated from the first nozzle array in the movement direction and an intersection direction that intersects with the movement direction, and the second nozzle array is in a position deviated from the first nozzle array in the intersection direction such that a center of the second nozzle array is apart from a center of the first nozzle array by a distance determined by 1/n of the length of the first nozzle array.

According to the above-described liquid ejecting device, in the n nozzles forming one set, the center of the first nozzle array and the center of the second nozzle are apart from each other by a distance determined by 1/n of the length of the first nozzle array. As a result, even when the phenomenon of ejection amount variances due to the first nozzle array and the second nozzle array occurs, the landing fluctuations due to the phenomenon of ejection amount variations in both the nozzle arrays cannot be easily overlapped with each other in the intersection direction. Accordingly, visual distinctiveness of the landing fluctuations can be suppressed.

In the above-described liquid ejecting device, it is preferable that a plurality of sets including the first nozzle array and the second nozzle array are arranged in the movement direction and ejects liquids of different types.

According to the above-described liquid ejecting device, liquids of a plurality of types can be ejected.

In the above-described liquid ejecting device, it is preferable that the first nozzle array includes a plurality of first nozzles that are disposed in the direction of arrangement at a predetermined nozzle pitch and the second nozzle array includes a plurality of second nozzles that are disposed in the direction of arrangement at a predetermined nozzle pitch such that a position of the second nozzle array is located between the first nozzles that are adjacent in the intersection direction.

According to the above-described liquid ejecting device, the density (for example, the resolution) of the liquids that land on a row along the intersection direction of the target can increase.

In addition, in the above-described liquid ejecting device, it is preferable that the first nozzle array includes a plurality of first nozzles that are disposed in the direction of arrangement at a predetermined nozzle pitch and the second nozzle array includes second nozzles located in positions that are adjusted to positions of the first nozzles in the intersection direction. In such a case, by controlling the ejection operation, the number of times of landing of the liquid in the target for each unit time can increase. Alternatively, by controlling the ejection operation, the liquid ejected from the second nozzle can land in a position in which the liquid ejected from the first nozzle lands.

In addition, it is preferable that the above-described liquid ejecting device further includes a liquid receiving member that receives a liquid that does not land in the target at a time when the liquid is ejected toward the target.

According to the above-described liquid ejecting device, damage or the like due to the liquid that does not land can be prevented.

In the above-described liquid ejecting device, it is preferable that the head unit is installed to an installation member to be fixed to a predetermined position and the movement mechanism moves the target in the movement direction.

In addition, it is preferable that the above-described liquid ejecting device further includes: a transport mechanism that transports the target in a transport direction that intersects with the movement direction; and a controller that controls the head unit, the movement mechanism, and the transport mechanism, wherein the movement mechanism moves the head unit in the movement direction, and the controller performs a movement and ejection operation for ejecting the liquid from the nozzles with the head unit moved in the movement direction and a transport operation for transporting the target in the transport direction by a unit amount transport that is defined within a range in which the liquid can be ejected from the nozzles.

Hereinafter, embodiments of the present invention will be described with reference to the accompanying drawings.

First Embodiment

Basic Configuration

Figure 2:
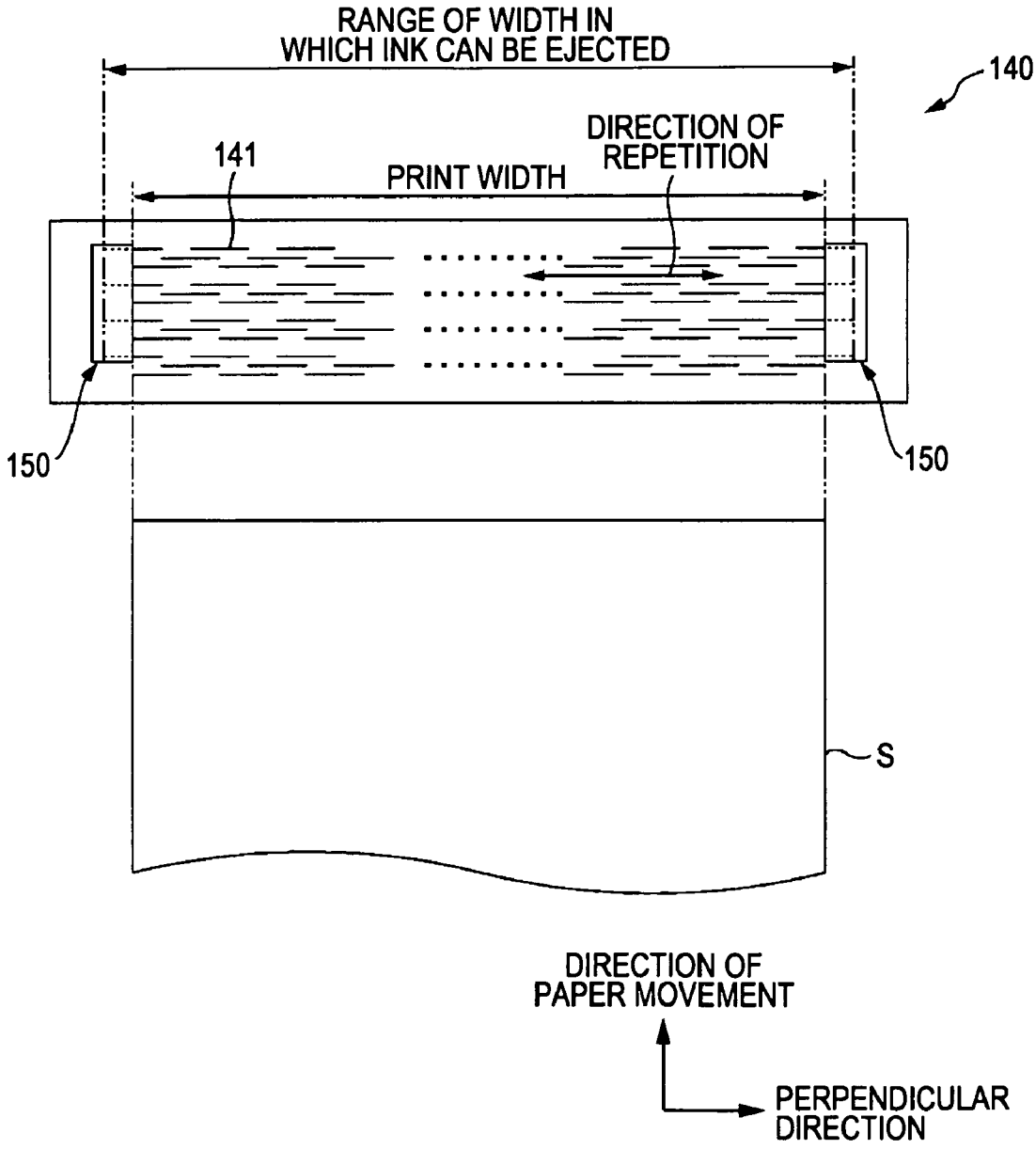
FIG. 2 is a schematic diagram showing relationship between a paper moving mechanism and an ink receiving member group that are included in the printer shown in FIG. 1.
Figure 3:
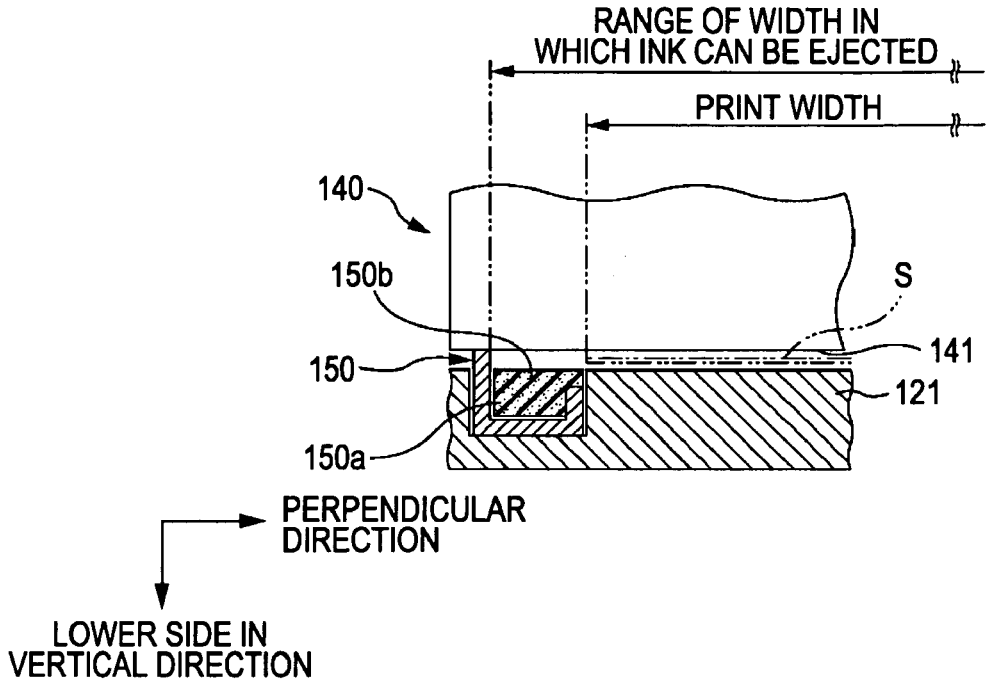
FIG. 3 is a cross-section view of the vicinity of the ink receiving member group shown in FIG. 2.
Figure 4:
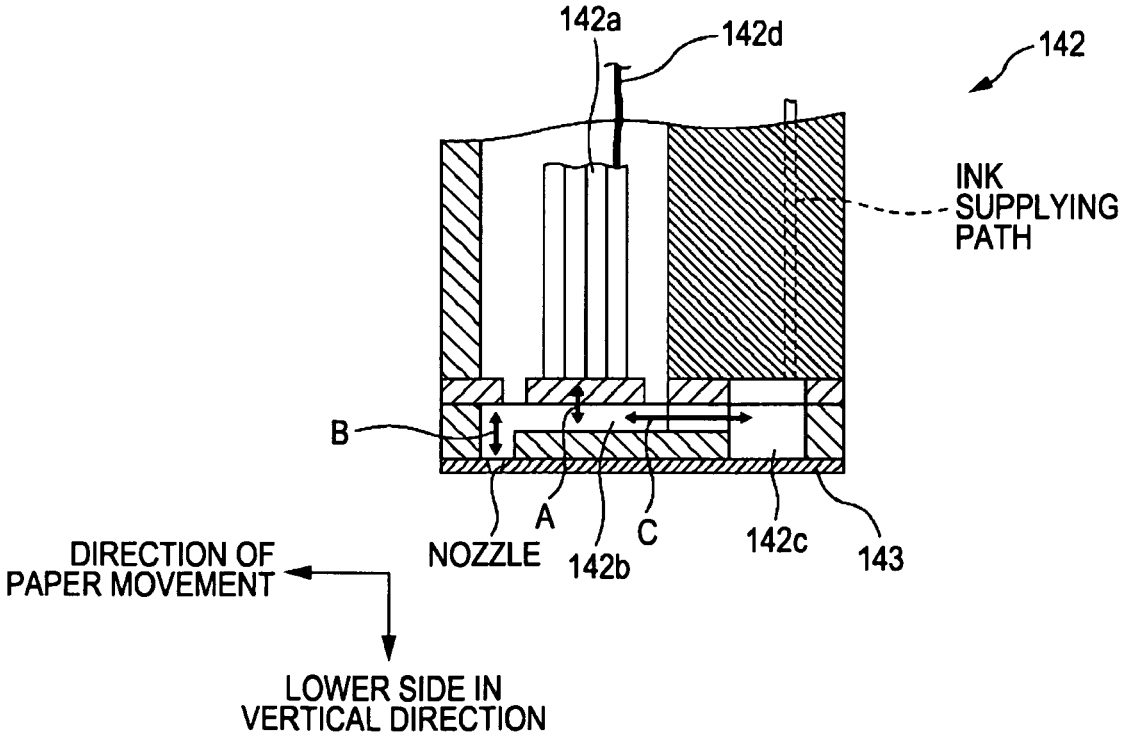
FIG. 4 is a partially enlarged cross-section view showing the internal configuration of a line head group according to an embodiment of the invention.

FIG. 1 is a schematic block diagram showing the configuration of a printing system. This printing system includes a printer that is an example of a liquid ejecting device. FIG. 2 is a schematic diagram showing relationship between a paper moving mechanism and an ink receiving member group that are included in the printer shown in FIG. 1. FIG. 3 is a cross-section view of the vicinity of the ink receiving member group shown in FIG. 2. FIG. 4 is a partially enlarged cross-section view showing the internal configuration of a line head group.

The printing system 1 shown in FIG. 1 has a computer 10 and a printer 100 that is connected to and communicatable with the computer 10. The printer 100 is used for printing an image corresponding to image data (for example, print data received from the computer 10) of a print target on a paper sheet S (see FIG. 2) in full colors. The printer 100 uses ink of a plurality of colors for implementing a full-color print process. The ink is in a liquid phase and is an example of a liquid. In descriptions here, the ink in the liquid phase will be simply referred to as ink.

The printer 100 employs an ink jet type. In the ink jet type, ink of a plurality of colors is ejected in the shape of droplets from a head unit 130 that is included in the printer 100. The above-described ink ejected in the droplet shape is also referred to as ink droplets. In a print process, the printer 100, first, moves a paper sheet S and then, performs an ink droplet ejecting operation in accordance with the movement of the paper sheet S. Then, the printer 100 stops the movement of the paper sheet S. Here, the ejected ink, for example, is dripped vertically to the lower side and lands in the paper sheet S. Thus, the paper sheet S is an example of a landing target (a target in which the liquid lands) in which ink droplets land. In addition, according to this embodiment, a configuration in which the paper sheet S is moved in a state that the head unit 130 is fixed is used. Thus, according to this embodiment, the precision of landing ink can be improved, compared to a case where both the head unit 130 and the paper sheet S are moved.

The printer 100, as shown in FIG. 1, includes a controller 110, a paper sheet moving mechanism 120, a head installation member 130*a*, and the head unit 130.

The controller 110 will now be described.

The controller 110 has a CPU 111, a memory 112, a clock generating circuit 113, a driving signal generating circuit 114, and an internal bus 115 that interconnects the above-described constituent members. The CPU 111 controls the paper moving mechanism 120 and the head unit 130 by reading and executing a program or the like that is stored in the memory 112. In a print process, the CPU 111 transmits the image data of the print target to the head unit 130. The clock generating circuit 113 generates a clock signal CLK and supplies the clock signal to each unit (the controller 110 and the head unit 130) of the printer 100. The driving signal generating circuit 114 generates a driving signal COM that is used for driving the head unit 130 and inputs the driving signal to the head unit 130.

The head installation member 130*a* is a member used for installing the head unit 130. In this embodiment, the position of the head unit 130 is determined by the head installation member 130*a*. In other words, the head unit 130 is fixed not to be moved. Thus, the head installation member 130*a* is an example of an installation member to which the head unit is installed.

For feeding and discharging a paper sheet, the paper moving mechanism 120 moves (transports) the paper sheet S in which ink droplets land one after another in the direction of paper movement shown in FIG. 2. The paper moving mechanism 120 includes a platen 121 that is used for supporting the rear side (the lower side in the vertical direction) of the paper sheet S in movement (see FIG. 3). The movement of the paper sheet S is performed in a state that the head unit 130 is installed to the head installation member 130*a* by the paper moving mechanism 120. Thus, the paper moving mechanism 120 is a moving mechanism that moves the paper sheet S and is an example of a moving mechanism that moves at least one between the landing target and the head unit. In addition, the direction of paper movement is an example of a movement direction.

The head unit 130 will now be described.

The head unit 130, as shown in FIG. 1, includes a line head group 140, a control circuit 131, and an ink supplying member group 132. The control circuit 131 controls the line head group 140 by processing a signal or the like (the image data, the clock signal CLK, and the driving signal COM) that is received from the controller 110 and inputting the signal to the line head group 140. In addition, in the line head group 140, an ink receiving member 150 is disposed. Here, the ink receiving member 150 is an example of a liquid receiving member.

The ink supplying member group 132 includes an ink tank group 133 and an ink supplying path group 134. The ink tank group 133 separately stores ink of four colors (black K, cyan C, magenta M, and yellow Y). The ink supplying path group 134 is configured by ink supplying paths of four systems corresponding to the four colors of the ink. The ink supply path of each system connects the ink tank group 133 and the line head group 140, and thus, serves to supply the ink stored in the ink tank group 133 to the line head group 140. In addition, since the ink of the four colors has a different system of the ink supplying paths (that is, ink supplying sources) and different colors (types), the ink is an example of a liquid of one type and corresponds to liquids of other types for the liquid of the one type.

In the line head group 140, a plurality of nozzle arrays 141 is disposed (see FIG. 2). Each nozzle array 141 has a plurality of nozzles (holes) (see FIG. 5). In a state that the line head group 140 is fixed, the plurality of nozzle arrays 141 is arranged in the direction of paper movement and is also arranged in a perpendicular direction that is a direction perpendicular to the direction of paper movement. As described above, by setting the nozzle arrays 141 of a specific number as one unit and arranging the plurality of nozzle arrays 141 in units of the specific number in the perpendicular direction (hereinafter, also referred to as a direction of repetition), a range (hereinafter, also referred to as the range of a width in which ink can be ejected) in which ink droplets can be ejected in the perpendicular direction can be expanded in the perpendicular direction. In the first embodiment, the width range in which the ink can be ejected is wider than a print width that represents the size of the paper sheet S, which is moved in the direction of paper movement, in the perpendicular direction. Accordingly, the printer 100 can perform so-called a no-margin printing operation that is a printing operation for printing an image on the entire surface of the paper sheet S.

Most of the plurality of nozzle arrays 141, as shown in FIG. 3, face the platen 121 in a state that nozzle arrays 121 are spaced apart by a predetermined distance from the platen. In addition, a part of the plurality of nozzle arrays 141 faces the ink receiving member 150. Here, the ink receiving member 150 will be described.

The ink receiving member 150, for example, is configured by a cantilever-type tray 150*a* that extends from the bottom (the lower face, the surface on the nozzle opening side) of the line head group 140 and a sponge 150*b* that is disposed on the inner periphery of the tray 150*a*. The tray 150*a* extends to the vicinity of the platen 121 (see FIG. 3), and the sponge 150*b* is disposed out of the range of the print width and is within the range of the width in which the ink can be ejected (see FIG. 2). The sponge 150*b* of the ink receiving member 150 can absorb ink and stores ink ejected from the opposing nozzle and ink that does not land in the paper sheet S. For example, the sponge 150*b* stores ink that does not land in the end edge of the paper sheet S along the direction of paper movement when the printer 100 performs a no-margin printing operation for the paper sheet S. Accordingly, it can be prevented that the ink ejected in an area out of the range of the print width is adhered to the paper sheet S (that is, damage of the paper sheet S due to ink droplets) that is the landing target.

Next, the internal configuration of the line head group 140 will be described.

The line head group 140 ejects ink in the shape of droplets and thus, has a plurality of ink ejecting mechanisms 142. In FIG. 4, one of the plurality of ink ejecting mechanisms 142 is shown. Each of the ink ejecting mechanisms 142 has a piezo element 142*a* that performs an ejection operation for ejecting ink droplets, an ink flowing path 142*b* through which ink flows, and a nozzle plate 143 in which nozzles are formed. The ink flowing path 142*b* is connected to the ink supplying path of one system and is communicated with one nozzle. In addition, between the ink supplying path of one system and the ink flowing path 142*b*, a common ink chamber 142*c* used for distributing ink flowing through the ink supplying path toward the plurality of nozzles is disposed. The piezo element 142*a* is disposed near the ink flowing path 142*b* that is disposed between the common ink chamber 142*c* and the nozzle.

To each piezo element 142*a*, a signal line 142*d* from the control circuit 131 is connected. Each piezo element 142*a* causes deformation (expansion or contraction) with a deformation amount corresponding to a voltage value that is represented by the driving signal COM that is input through the signal line 142*d* (see arrow A shown in FIG. 4). The deformation of each piezo element 142*a* causes a change of the pressure of ink that flows through the ink flowing path 142*b* formed in the vicinity thereof. Thus, the flow of ink is generated near the nozzle in accompaniment with the change of the pressure of the ink (arrow B). As a result, from the nozzle that is the opening of the ink flowing path 142*b*, ink droplets of an amount corresponding to the change of the pressure (a pressure increase) of the ink are ejected. In addition, based on the change of the pressure of the ink, the flow of ink is generated in the common ink chamber 142*c* that is located on the opposite side of the nozzle (arrow C).

Disposition of Nozzle Array 141

Figure 5:
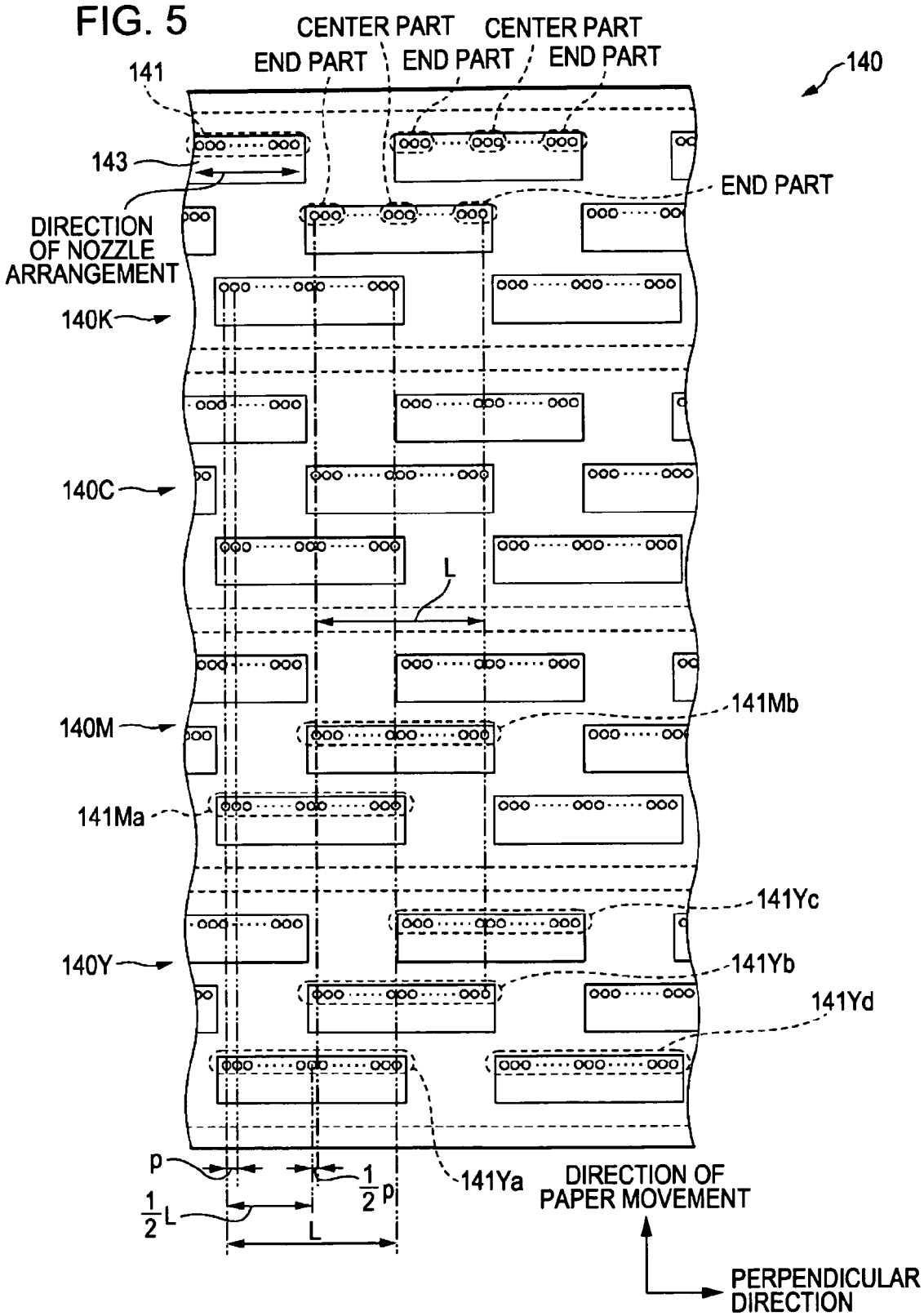
FIG. 5 is a partially enlarged view of the line head group shown in FIG. 2, viewed from the nozzle side.

Next, disposition of the plurality of nozzle arrays 141 that are disposed in the line head group 140 of the head unit 130 shown in FIG. 2 will be described in detail with reference to FIG. 5. FIG. 5 is a partially enlarged view of the line head group 140 shown in FIG. 2, viewed from the nozzle side.

As shown in FIG. 5, the line head group 140 includes a line head 140K corresponding to black ink, a line head 140C corresponding to cyan ink, a line head 140M corresponding to magenta ink, and a line head 140Y corresponding to yellow ink. In the line head group 140, each line head is arranged in the direction of paper movement.

In each line head 140K, 140C, 140M, or 140Y, as shown in FIG. 5, a plurality of the nozzle plates 143 is disposed. The nozzle plate 143 is an example of a nozzle forming member in which a plurality of nozzles is formed. In each nozzle plate 143, multiple (for example, 180) nozzles included in one nozzle array 141 are formed at a predetermined nozzle pitch p in a predetermined arrangement direction (hereinafter, also referred to as a direction of nozzle arrangement). In this embodiment, the direction of nozzle arrangement is a direction that intersects with the direction of paper movement and corresponds to the intersection direction. Since the direction of nozzle arrangement is the same as the perpendicular direction that is perpendicular to the direction of paper movement, the disposition space in the direction of paper movement can be effectively used. As a result, miniaturization of the head unit 130 is achieved. In this embodiment, the direction of nozzle arrangement is the same as the direction of repetition of the nozzle array 141.

Here, one line head (a line head that ejects ink of a specific color) will be primarily considered. The plurality of nozzle arrays 141 belonging to one line head is arranged in the direction of repetition with three nozzle arrays 141 adjacently arranged in the direction of paper movement used as one unit. This direction of repetition is a direction that intersects with the direction of paper movement and corresponds to the intersection direction. In this embodiment, the direction of repetition is set to the perpendicular direction that is perpendicular to the direction of paper movement.

In addition, in this embodiment, the nozzle arrays 141 of each line head are disposed over three rows in the direction of paper movement, and the plurality of nozzle arrays 141 is arranged in each row in the perpendicular direction. One unit that is configured by three rows for the line head 140Y, for example, corresponds to a set of three nozzle arrays 141Ya, 141Yb, and 141Yc. However, instead of the above-described nozzle arrays, a set of three nozzle arrays 141Yb, 141Yc, and 141Yd may correspond to the one set.

Among the three nozzle arrays 141, any arbitrary two nozzle arrays 141 and 141 (a first nozzle array and a second nozzle array) are disposed in positions to be deviated from each other in the direction of paper movement. In addition, between the two nozzle arrays 141 and 141, the nozzle array 141 disposed on the upstream side in the direction of paper movement is disposed in a position to be deviated from the nozzle array 141, which is disposed on the downstream side in the direction of paper movement, in the perpendicular direction. The positional deviation in the perpendicular direction is determined such that an end part of one nozzle array 141, between one pair of nozzle arrays 141 and 141 that are closest to the direction of paper movement, is located in the center part of the other nozzle array 141. Briefly, two nozzle arrays 141 and 141 are in positions deviated from each other in the perpendicular direction by an approximate half (that is, L/2) of a length L that represents a distance between both ends of the nozzle array 141.

For example, a pair of the nozzle arrays 141Ya and 141Yb, a pair of the nozzle arrays 141Yb and 141Yc, a pair of the nozzle arrays 141Yc and 141Yd, or a pair of the nozzle arrays 141Ma and 141Mb shown in FIG. 5 corresponds to the two nozzle arrays 141 and 141 disposed as described above. Each pair (set) of the nozzle arrays shown in this example is configured by a reference nozzle array (a first nozzle array) that becomes a reference of the position and the other nozzle array (a second nozzle array) that ejects ink of a same type as that of the reference nozzle array. The other nozzle array is disposed in a position deviated from the reference nozzle array in the direction of paper movement (an example of the direction of movement) and the perpendicular direction (an example of the intersection direction) such that the end part of the other nozzle array is located between the one end and the other end of the reference nozzle array. In addition, the other nozzle array is disposed in a position deviated from the reference nozzle array in the perpendicular direction. For example, the other nozzle array is in a position deviated such that the end part of the other nozzle array in the perpendicular direction is disposed in a position (that is, a position deviated by L×½ in the perpendicular direction) determined based on the length L of the reference nozzle array and the number n (in this example, two) of nozzle arrays that configure one pair.

As a result of the above-described disposition of the nozzle arrays 141, in both end parts of each line head, there is a range in which two nozzle arrays 141 and 141 are not overlapped with each other in the perpendicular direction (see FIG. 2). However, in this embodiment, the above-described ink receiving member 150 is disposed such that ink can be ejected from nozzles located in the non-overlapped range at a time when ink is ejected toward the paper sheet S. In other words, the ink receiving member 150 is disposed in an area that is broader than a range needed for a no-margin print operation. In particular, the ink receiving member 150 is disposed in an area that is outside the range of the print width and in a range (see FIG. 2) within the range of the width in which ink can be ejected (see FIG. 2).

In addition, in the first embodiment, each nozzle (corresponding to the second nozzle) included in one nozzle array 141 is disposed between nozzles located adjacent in the perpendicular direction among the nozzles (corresponding to the first nozzles) included in the other nozzle array 141. For example, a nozzle that is located in the end part of the one nozzle array 141 is deviated in the perpendicular direction by a half (that is, p/2) of the nozzle pitch p from a nozzle that is located in the exact center of the other nozzle array 141. By disposing the nozzles as described above and controlling ink ejection to be described later, the density (that is, a print resolution for the width direction) of ink that lands in rows disposed along the perpendicular direction (hereinafter, also referred to as a width direction) of the paper sheet S can increase to be twice the print resolution that is defined by the nozzle pitch p.

Subsequently, two line heads having different colors (types) of ink will be primarily considered.

In FIG. 5, the positions (positions in the perpendicular direction) of one nozzle array 141 included in the line head that ejects ink of a specific color are adjusted to the positions of both ends of one nozzle array 141 included in the line head that ejects ink of a different color. Here, since the plurality of nozzle plates 143 having a same configuration is used, the nozzle pitches p and the numbers of nozzles of both the nozzle arrays 141 and 141 are adjusted to each other.

In other words, in the line head group 140, a plurality of nozzle arrays 141 is disposed in the direction of paper movement so as to adjust positions of both ends thereof in the perpendicular direction. The plurality of nozzle arrays 141 arranged in the direction of paper movement has a nozzle array 141 belonging to a line head that ejects ink of a specific color and a nozzle array 141 belonging to a line head that ejects ink of a different color.

For example, in FIG. 5, the positions of both ends of the nozzle array 141Ya (one example of the first nozzle array) are adjusted to the positions of both ends of the nozzle array 141Ma (one example of the first nozzle array). In addition, the positions of both ends of the nozzle array 141Yb (one example of the second nozzle array) are adjusted to the positions of both ends of the nozzle array 141Mb (one example of the second nozzle array). As described above, a set of nozzle arrays including the nozzle arrays 141Ya and 141Yb and a set of nozzle arrays including the nozzle arrays 141Ma and 141Mb are arranged in the direction of paper movement, and accordingly, ink of different colors is configured to be ejected from the sets of the nozzle arrays.

To sum up descriptions above, according to this embodiment, by disposing the nozzle arrays 141 over two rows in the direction of paper movement such that the print resolution in the width direction becomes twice the resolution defined by the nozzle pitch p, a plurality of nozzles is arranged. In addition, in the line head that ejects one color, an end part of one nozzle array 141 between two nozzle arrays 141 and 141 including nozzles arranged for doubling the print resolution is located in the center part of the other nozzle array 141 in the perpendicular direction. In addition, in line heads that eject ink of two colors, the positions of both ends of the nozzle array 141 included in one line head and the positions of both ends of the nozzle array 141 included in the other line head are adjusted to each other in the perpendicular direction.

Here, a control operation for ejecting ink which is performed by the controller 110 will be described.

According to this embodiment, the controller 110 controls timings for ink ejection such that, between two nozzle arrays 141 and 141 belonging to the line head that ejects ink of one color, ink droplets ejected from the nozzle array 141 disposed on the upstream side in the direction of paper movement and ink droplets ejected from the nozzle array 141 disposed on the downstream side in the direction of paper movement land in one row along the perpendicular direction (width direction) that is perpendicular to the direction (the direction in which the paper sheet S is moved) of paper movement for the paper sheet S. In particular, first, ink droplets are ejected from the nozzle array 141 disposed on the upstream side in the direction of paper movement. Then, ink droplets are ejected from the nozzle array 141 disposed on the downstream side in the direction of paper movement in accordance with the position of the paper sheet S in the direction of paper movement. At that moment, the ink droplets ejected from the nozzle (one example of the second nozzle) of the nozzle array 141 disposed on the downstream side in the direction of paper movement land between positions in which ink droplets ejected from adjacent nozzles (one example of the first nozzle) of the nozzle array 141 disposed on the upstream side in the direction of paper movement. Accordingly, the density of ink that lands in the row along the width direction of the paper sheet S becomes twice the density of ink for a case where ink is ejected from one nozzle array 141. In other words, the print resolution for the width direction can be twice that for a case where ink is ejected from one nozzle array 141 for ink of each color.

Figure 6:
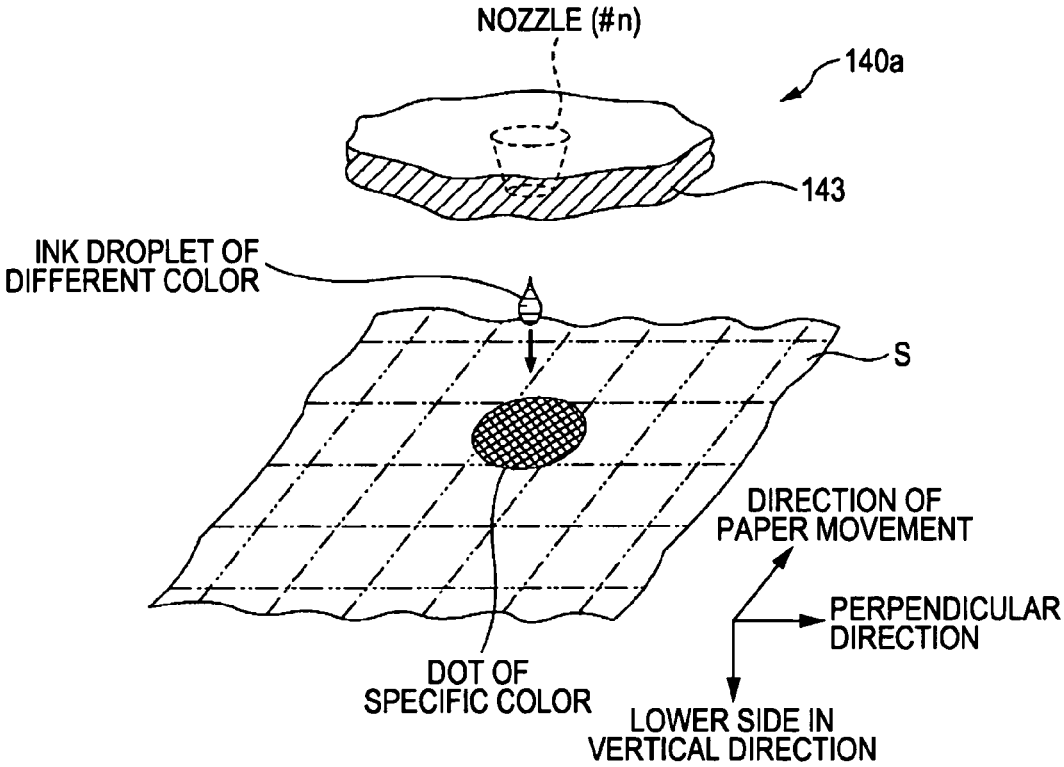
FIG. 6 is a diagram showing a state in which a plurality of ink droplets lands in a same position on a paper sheet S according to an embodiment of the invention.

In addition, the controller 110 also controls timings for ink ejection for landing ink droplets of a plurality of colors in a same position on the paper sheet S. First, an ink droplet is ejected from a nozzle, which has a nozzle number #n, of a nozzle array 141 of the line head (for example, the line head 140Y that ejects yellow ink) that is disposed on the upstream side in the direction of paper movement and ejects ink of a specific color at a specific timing. Accordingly, a dot of the specific color is formed on the paper sheet S. In addition, the nozzle number is used for the convenience of description and represents the arrangement order of a nozzle in the perpendicular direction, that is, a position of the nozzle in the perpendicular direction. At a timing thereafter, the controller 110 ejects an ink droplet from a nozzle, which has the nozzle number #n, of a nozzle array 141 of a line head (for example, a line head 140M that ejects magenta ink) that is disposed on the downstream side in the direction of paper movement and ejects ink of a different color. At this moment, the controller 110 controls the timing for ejecting ink such that the ink droplet is ejected toward a dot (landing position) of the specific color (see FIG. 6). As a result, ink droplets of two colors ejected from nozzles having the same nozzle number #n land in a same position, and accordingly, dots of the two colors are overlapped with each other on the paper sheet S. Similarly, Ink droplets of different colors land. Accordingly, the printer 100 can represent different colors on the paper sheet S by using ink of a plurality of colors. In addition, that the nozzle numbers #n of the two nozzles are the same corresponds to that the positions of the two nozzles are adjusted to each other in the perpendicular direction.

In addition, in an ordinary print process, the controller 110 controls ink ejection such that ink is aggressively ejected from nozzles located in a range in which two nozzle arrays 141 and 141 are not overlapped with each other in the perpendicular direction in both end parts of each line head. By performing the above-described control operation, the influence of crosstalk (to be described later) can be alleviated, compared to a case where ink is not ejected. In addition, ink droplets aggressively ejected from the nozzles located in the non-overlapped range are received by the ink receiving member 150, and accordingly, it can be assuredly prevented that the ink droplets are adhered to the paper sheet S (that is, a damage of the paper sheet S due to the ink droplets or the like is generated). In addition, when the influence of the crosstalk cannot easily appears, the controller 110 controls ink ejection such that ink is not ejected from the nozzles located in the non-overlapped range. Accordingly, the amount of consumption of ink can be reduced.

The controller 110 repeatedly performs a paper moving control operation for moving the paper sheet S by using the paper moving mechanism 120 and the above-described ink ejecting control operation. As a result, a printed material is acquired.

Landing Fluctuation

Subsequently, landing fluctuations in a printed material will be described. As a reason for the landing fluctuation, there is a phenomenon of an ejection amount variation. The phenomenon of an ejection amount variation represents a phenomenon in which the amount of ejection of ink to be ejected from a nozzle deviates from a target amount of ejection. In other words, the phenomenon of an ejection amount variation represents a phenomenon in which the amount of ejection of ink increases or decreases. In such a case, the sizes of dots formed in accordance with variances of the amounts of ejection become different, and thus, landing fluctuations are generated.

Bathtub Phenomenon

When a print operation is performed by using a specific nozzle array 141 such that the amounts (the sizes of dots at a time when ink lands) of ejection of ink ejected from each nozzle are controlled to be uniform, there is a case where a phenomenon of an increase in the ejection amount (so-called a bathtub phenomenon) such as a case where the amounts of ejection of ink droplets ejected from the nozzles located in both end parts of the nozzle array 141 relatively increase with respect to the amount of ejection $A_1$ of ink droplets ejected from nozzles located in the center part of the nozzle array 141 occurs. Here, in this embodiment, a side on which the bathtub phenomenon of ink ejected from the specific nozzle array 141 occurs and a side on which the bathtub phenomenon of ink ejected from a different nozzle array 141 occurs are almost the same. The bathtub phenomenon is an example of the phenomenon of the ejection amount variations. As a reason for generating the bathtub phenomenon, there is a shape of the above-described common ink chamber 142*c*.

Figure 7:
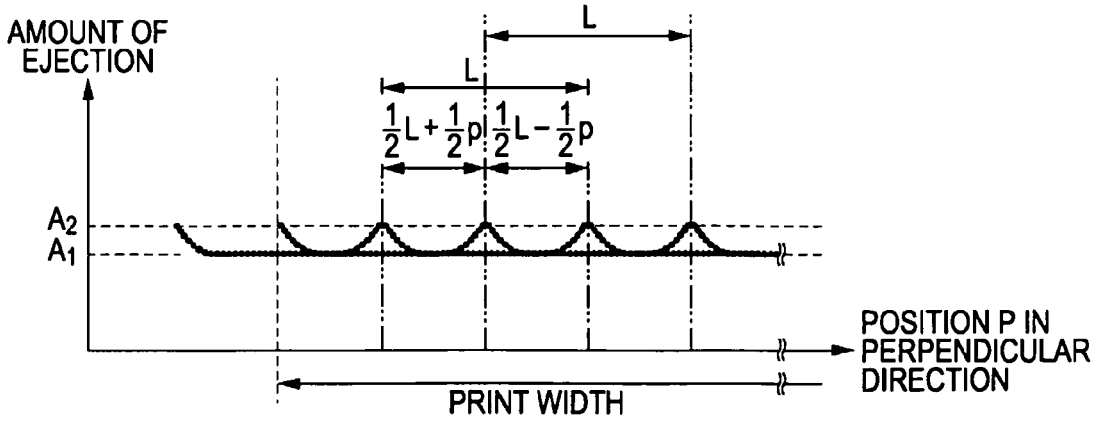
FIG. 7 is a diagram showing a phenomenon (bathtub phenomenon) of ejection amount variances that occurs in a print operation by using the printer shown in FIG. 1.

In a case where the above-described bathtub phenomenon occurs, when a print operation for the paper sheet S is performed by using the head unit 130 in which the nozzle array 141 is disposed as shown in FIG. 5, parts (the landing fluctuation of the amount of ejection $A_2$ that is larger than the amount of ejection $A_1$) in which the amount of ejection increases due to the bathtub phenomenon appear at intervals of an approximately half (that is, L/2) of the length L of the nozzle array 141 in the perpendicular direction (see FIG. 7). In addition, the landing fluctuations are arranged in the direction (the direction in which the paper sheet S is moved) of paper movement. The interval of the landing fluctuations in the perpendicular direction corresponds to a positional deviation between two nozzle plates 143 in the perpendicular direction by an approximately half (that is, L/2) of the length L in the perpendicular direction.

Here, a reference example as opposed to this embodiment will be described. In a head unit 230 according to this reference example, differently from this embodiment, nozzle plates 143 are disposed such that the positions of both end parts of two nozzle arrays 141 and 141 are approximately adjusted to each other in the perpendicular direction (see FIG. 8A). However, also in the head unit 230 according to this reference example, similarly to this embodiment, the print resolution for the width direction is doubled by having the positions between nozzles of two nozzle arrays 141 and 141 deviated from each other in the perpendicular direction by a half (that is, p/2) of the nozzle pitch p. In the above-described reference example, since the positions of both ends of two nozzle arrays 141 and 141 are approximately adjusted to each other, the parts (the landing fluctuation of the amount of ejection $A_2$) in which the amount of ejection increases become close to each other (see FIG. 8B). Although when the nozzles are slightly deviated in the perpendicular direction, a part in which the landing fluctuations are close to each other as described above may be seen by a user as if the amount of ejection of ink increases (for example, the amount of ejection increases up to the ejection amount $A_3$ that is larger than the ejection amount $A_1$ or $A_2$). For example, a part of an area that is clearly printed in a light yellow looks as if the part is printed in dark yellow. As a result, the area of the dark yellow becomes visually distinctive.

To sum up, according to the first embodiment, between two nozzle arrays 141 and 141, which have a same configuration, of one line head, the end part of one nozzle array 141 is located in the center part of the other nozzle array 141 in the perpendicular direction. Thus, even when the bathtub phenomena occur due to the ink ejecting mechanism including the nozzle arrays 141, it can be prevented that the landing fluctuations due to both the bathtub phenomena become close to each other in the perpendicular direction. In addition, the positions having the landing fluctuations are dispersed in the perpendicular direction depending on the positional relationship between the end part and the center part. In other words, by disposing the plurality of nozzle arrays 141 as in this embodiment, the positions having landing fluctuations can be dispersed uniform in the perpendicular direction. Accordingly, the visual distinctiveness of the landing fluctuations can be suppressed, compared to a case where the nozzle arrays 141 are disposed according to the reference example.

In addition, in this embodiment, since the ink receiving member 150 is disposed in a broad range, ink ejected from nozzles located in a range in which one nozzle array 141 among the plurality of nozzles constituting two nozzle arrays 141 and 141 and the other nozzle array 141 are not overlapped with each other in the perpendicular direction can also be received. As a result, according to this embodiment, adherence (that is, damage or the like of the paper sheet S due to ink droplets) of ink droplets ejected outside the range of the print width to the paper sheet S can be prevented.

Although the description for one line head (that is, a line head that ejects ink of one color) has been made as above, a same description can be applied to another line head (a line head that ejects ink of a different color).

Color Balance

The bathtub phenomenon also has an influence on a case where different colors are represented by using ink of a plurality of colors. The printer 100 represents different colors by landing ink droplets of a plurality of colors at a predetermined ratio (that is, the color balance) of the amounts of ejection in a same position. In such a case, when the landing fluctuations are generated for each color, the color balance is broken.

Here, in this embodiment, the positions (positions in the perpendicular direction) of both ends of one nozzle array 141 included in the line head that ejects ink of a specific color are adjusted to the positions of both ends of one nozzle array 141 included in the line head that ejects ink of a different color. Accordingly, when the bathtub phenomenon occurs, the landing fluctuations may be easily overlapped with each other in the perpendicular direction.

In particular, in a part on the paper sheet S corresponding to the end part of the nozzle array 141, ink droplets of two colors of which amounts of ejection equivalently have increased are overlapped with each other. In addition, in a part on the part on the paper sheet S corresponding to the center part of the nozzle array 141, ink droplets of two colors of which amounts of ejection have not increased are overlapped with each other. As a result, according to this embodiment, in the part in which the ink drops of two colors, of which amounts of ejection have increased equivalently, are overlapped with each other, the ratio (the color balance) of the amount of ejection of ink of the specific color to the amount of ejection of ink of the different color cannot be easily broken. In other words, according to this embodiment, a state in which the color balance is broken in a relatively small amount can be maintained. In addition, according to this embodiment, in order to approximately matching sides on which the bathtub phenomena occur, the directions of repetition of the nozzle arrays 141 are adjusted by using a plurality of nozzle plates 143 having the same nozzle pitch p and the same number of nozzles. As a result, the visual distinctiveness of broken color balance (broken ratio of the amounts of ink ejection) can be suppressed.

Figure 9A:
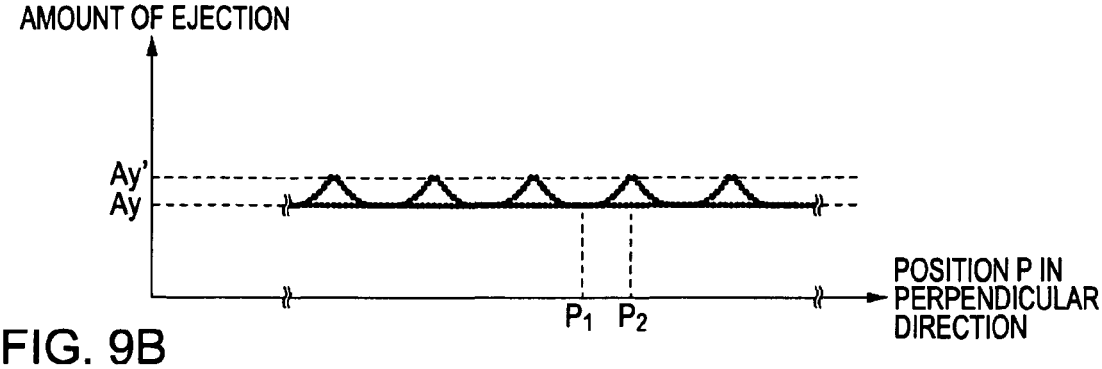
FIG. 9A is a diagram showing a ratio (color balance) of ejection amounts in a printed material printed by using the printer shown in FIG. 1 and is a diagram showing the phenomenon of ejection amount variances for yellow ink.
Figure 9B:
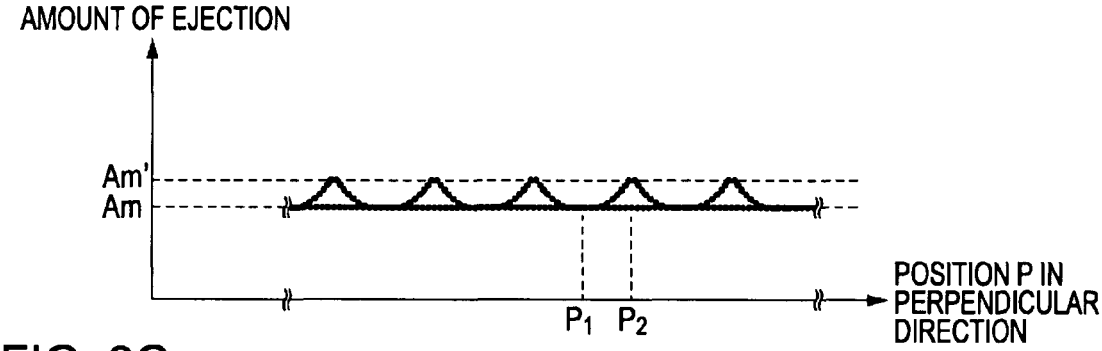
FIG. 9B is a diagram showing the phenomenon of ejection amount variances for magenta ink.
Figure 9C:
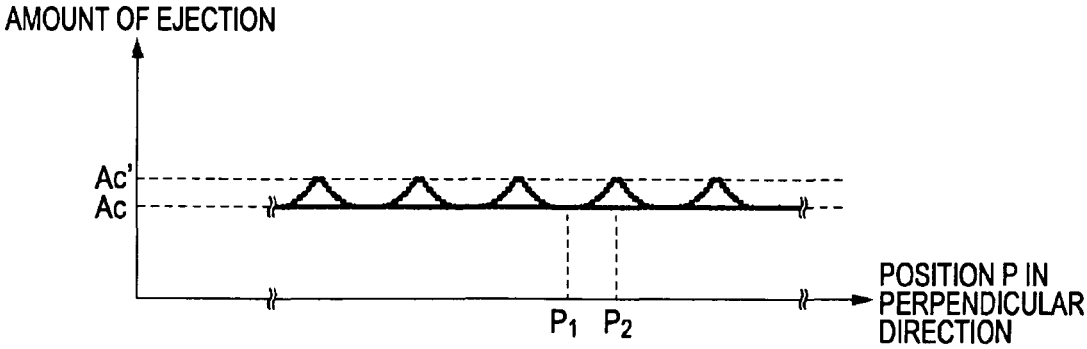
FIG. 9C is a diagram showing the phenomenon of ejection amount variances for cyan ink.
Figure 9D:
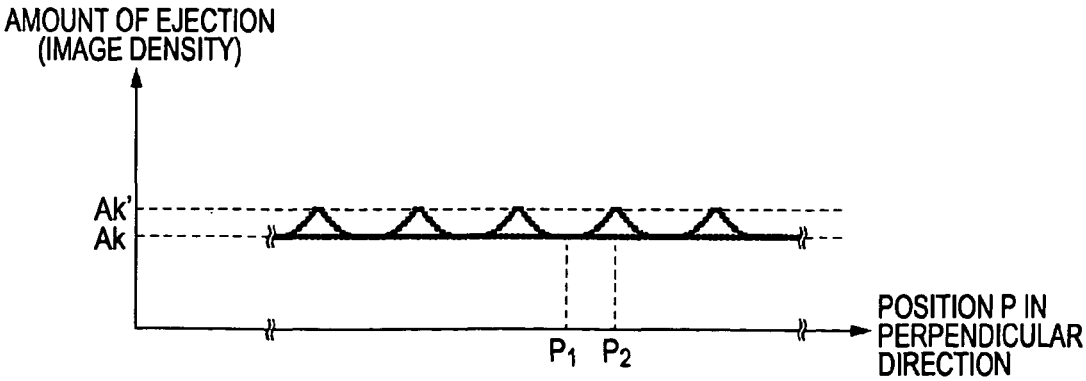
FIG. 9D is a diagram showing the phenomenon of ejection amount variances for a color (black) that is formed by ink of three colors shown in FIGS. 9A to 9C.

For example, for the amount of ejection of yellow ink shown in FIG. 9A and the amount of ejection of magenta ink shown in FIG. 9B, a ratio (Ay'/Am') of the amounts of ejection in a position $P_2$ corresponding to the end parts of two nozzle arrays 141 and 141 of which positions of both ends are adjusted to each other and a ratio (Ay/Am) of the amounts of ejection in a position $P_1$ corresponding to the center part do not change much. The reason is that the amounts Ay' and Am' of ejection in the position $P_2$ are larger than the amounts Ay and Am of ejection in the position $P_1$ due to the bathtub phenomena, and increases (a difference of Ay'−Ay and a difference of Am'−Am) in the amounts of ejection for each color are equivalent to each other. This applies for three colors or four colors. FIGS. 9A to 9C show the amounts of ink of three colors (yellow, magenta, and cyan) landed so as to be overlapped with pixels belonging to one row along the width direction on the paper sheet S. FIG. 9D shows the amount (the image density) of ejection of a color (black) that is formed in accordance with the ratio of the amounts of ejection of ink of three colors shown in FIGS. 9A to 9C.

Crosstalk

Figure 10A:
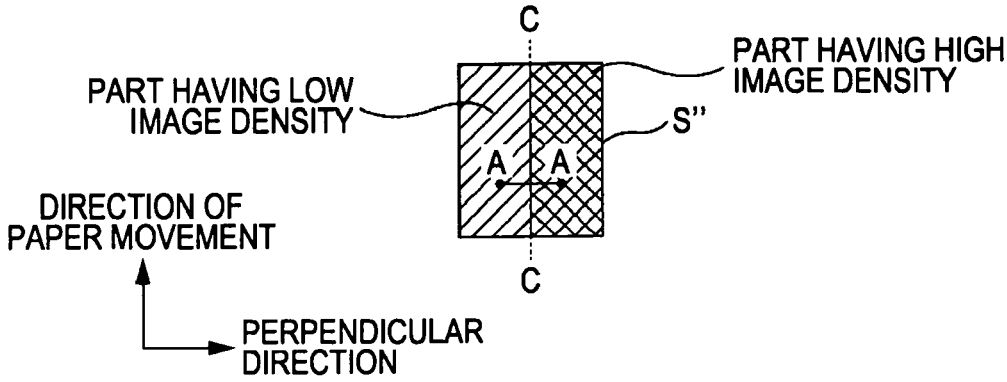
FIG. 10A is a diagram showing appearance of another printed material printed by using the printer shown in FIG. 1.

Next, a case where a printed material S" as shown in FIG. 10A is acquired by using the head unit 130 in which the nozzle arrays 141 are disposed as shown in FIG. 5 will be described. The printed material S' shown in FIG. 10A is a printed material that is acquired from so-called a beta print process. In the print process, a print operation in monochrome is performed such that a center line C-C of the paper sheet S in the perpendicular direction is used as a boundary and the image density (for example, Aa) of a part located on the left side of the boundary is lower than the image density (for example, Ab) of a part located on the right side of the boundary.

Figure 10B:
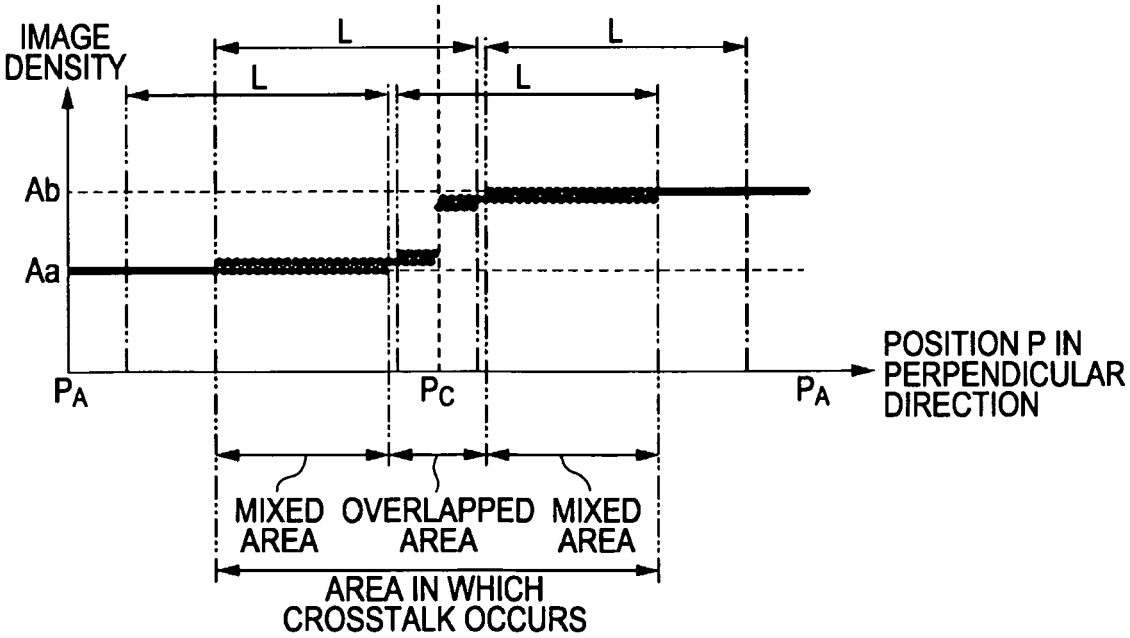
FIG. 10B is a diagram showing the phenomenon (crosstalk) of the ejection amount variances in the printed material shown in FIG. 10A.

FIG. 10B is a diagram showing the phenomenon (crosstalk) of the ejection amount variance in the printed material S" shown in FIG. 10A and represents an example of the image density in line A-A that intersects with line the center line C-C shown in FIG. 10A. Even when an image is printed differently between one side and the other side that are acquired from partitioning the image center under control with the center line C-C, as shown in FIG. 10B, the image density of the actually acquired printed material S" is not divided into two levels with the center position $P_C$ corresponding to the center line C-C used as a boundary. As the reason that the image density is not divided into two levels, different use ratios of nozzles of one nozzle array 141 may be considered. For example, when ink droplets of different amounts are ejected from one nozzle array 141, ink droplets of a relatively small amount increase in the amounts of ejection influenced by ink droplets of a relatively large amount. Similarly, the ink droplets of the relatively large amount decrease in the amounts of ejection influenced by the ink droplets of the relatively small amount. Although this phenomenon is an example of the phenomenon of the ejection amount variances, the phenomenon is particularly referred to as crosstalk. The crosstalk has an influence on the nozzle array 141 that includes nozzles that eject ink droplets landing in a position near the boundary such as the center position $P_C$.

When the head unit 130 according to this embodiment is used, the image density (amount of ejection) of ink corresponding to a part having high image density, as shown in FIG. 10B, is controlled to be lowered to multiple levels from a position PA corresponding to one end of line A-A to the center position $P_C$. This represents that the amount of ejection of ink is lowered to three levels in the area. The reason why the amount of ejection is lowered to three levels is that the amount of ejection changes depending on the number 0 to 2 of nozzle arrays 141, between two nozzles arrays 141 and 141 that eject ink droplets on a row along the width direction of the paper sheet S, that are influenced by the crosstalk. In addition, the image density (amount of ejection) of ink corresponding to a part having low image density increases in multiple levels (three levels) as the part is located closer to the center position $P_C$. As described above, by changing the image density in three levels, even when a change of the color (image density) in the printed material S" is visually recognized by the user, the change is recognized gently. As a result, according to this embodiment, visual distinctiveness of landing fluctuations due to the influence of the crosstalk can be suppressed.

Figure 8A:
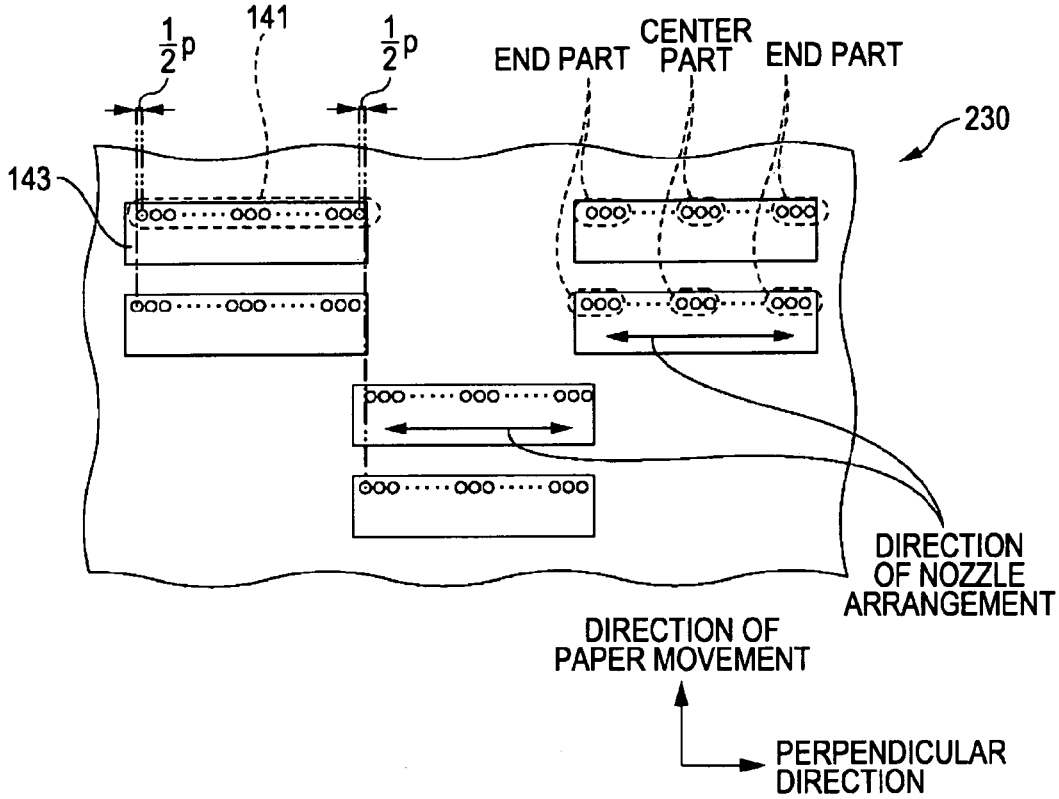
FIG. 8A is a schematic diagram showing a part of the configuration of a head unit according to a reference example.
Figure 8B:
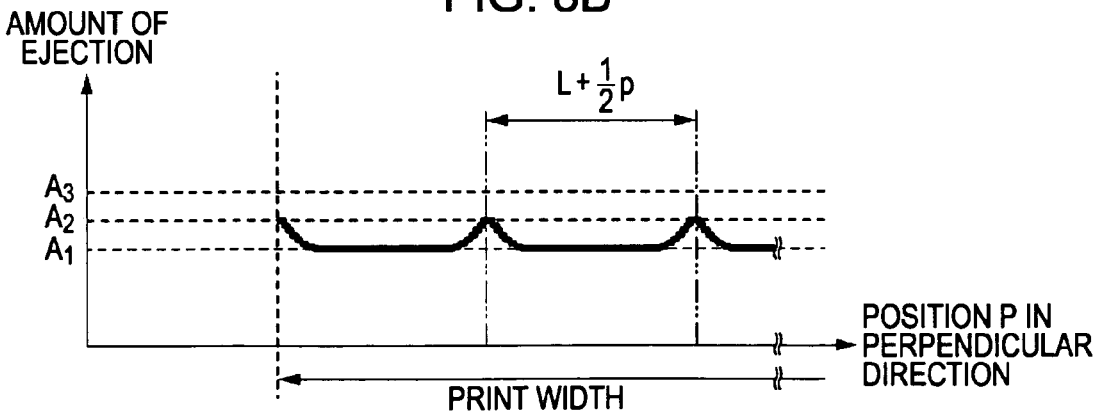
FIG. 8B is a diagram showing a phenomenon (bathtub phenomenon) of ejection amount variances in a printed material printed by using the head unit shown in FIG. 8A.
Figure 11:
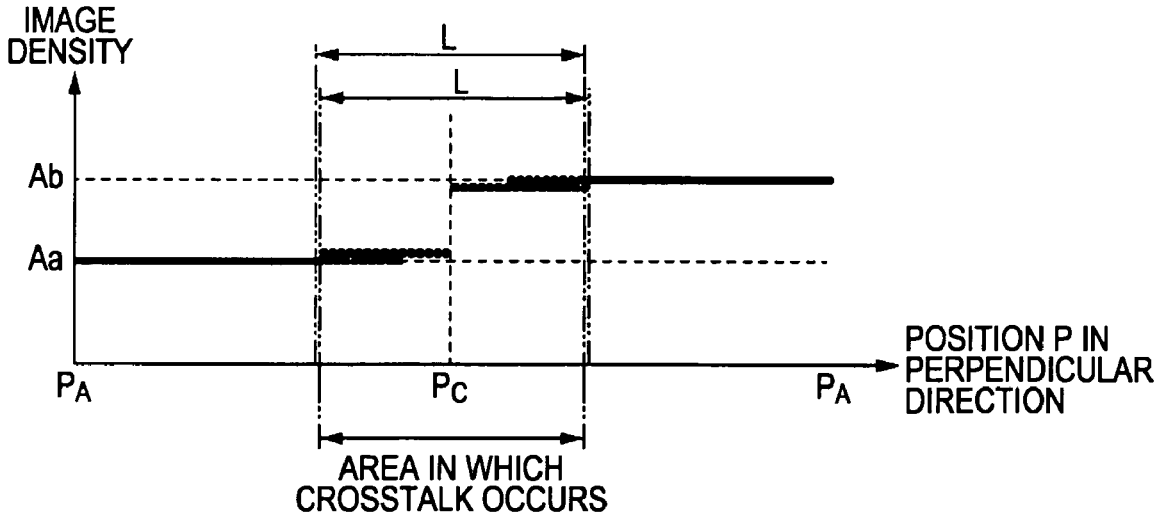
FIG. 11 is a diagram showing the phenomenon (crosstalk) of ejection amount variances in the same printed material as shown in FIG. 10A which is printed by using the head unit shown in FIG. 8A.

On the other hand, when a same printed material S" shown in FIG. 10A is acquired by using the head unit 230 according to the reference example shown in FIG. 8A, as shown in FIG. 11, a part having high image density and a part having low image density are divided into two levels, respectively. The reason is that, in the reference example, both the two nozzle arrays ejecting ink droplets to one row on the paper sheet S may receive or may not receive the influence of the crosstalk. When the parts are divided as described above, the change of the printed material in the color (image density) becomes visually distinctive to the user.

In addition, the crosstalk has an influence on the nozzle arrays including a plurality of nozzles that do not eject ink. The reason is that no ejection of ink corresponds to the lowest image density. In particular, in this embodiment, in both end parts of the line head, the positions of two nozzle arrays 141 and 141 are not overlapped with each other in the perpendicular direction of nozzles are not overlapped with each other in the perpendicular direction in both the end parts of the line head, and accordingly, the nozzle arrays 141 including nozzles outside the range of the print width are in both end parts of each line head. In such nozzle arrays 141, when ink ejection is performed from a plurality of nozzles located within the range of the print width, unnecessary ink ejection from the side of nozzles located outside the range of the print width may be performed. In addition, the unnecessary ink droplets ejected as described above can be received by the ink receiving member 150.

On the other hand, in the nozzle array 141, the side of nozzles that are located within the range of the print width and eject ink is influenced by the side of nozzles that do not eject ink, and thus, the amount of ejection of ink decreases. In order to suppress the decrease of the amount of ejection of ink as described above, according to this embodiment, the controller 110 controls the ink ejection such that ink is ejected from the nozzles located outside the range of the print width. The ink droplets ejected from the nozzles outside the range of the print width are received by the ink receiving member 150. By performing the control operation as described above, the influence of the crosstalk within the range of the print width can be alleviated, compared to a case where ink ejection is not performed aggressively.

In addition, in the above-described embodiment, a case where two nozzle arrays 141 and 141 have a same configuration has been described. However, the two nozzle arrays 141 and 141 are not needed to have an exactly same configuration. For example, between the two nozzle arrays 141 and 141, the numbers of nozzles, the nozzle pitches p, and the directions of nozzle arrangement of the nozzle arrays 141, the direction of repetition of the nozzle arrays 141, or the like may be slightly different from each other. In addition, the positions of both ends of the two nozzle arrays 141 and 141 that eject ink of different colors are not needed to be completely adjusted in the perpendicular direction to each other and may be slightly different from each other. Even in such a case, the phenomena of the ejection amount variations occur in an equivalent degree due to the ink ejecting mechanism including the nozzle arrays 141, and thus, the same operations and advantages as those of the above-described embodiment are acquired.

Range of Center Part of Nozzle Array 141

In the above-described embodiment, in order to double the print resolution for the width direction, two nozzle arrays 141 and 141 are arranged in the direction of paper movement. In particular, in the example shown in FIG. 5, the two nozzle arrays 141 and 141 are arranged such that the position of the center part of one nozzle array 141 is located in the position of an approximately half (that is, L/2) of the length L of the other nozzle array 141. However, in arranging N nozzle arrays 141, the position of the center part (hereinafter, simply referred to as a center part) of a nozzle array is not limited to the position corresponding to ½ of the length L of the other nozzle array 141. This will be described in detail. Here, an integer N represents the number of the nozzle arrays 141, in which nozzles are arranged at a predetermined nozzle pitch p, to be arranged in the direction of paper movement for implementing the print resolution for the width direction.

Figure 12A:
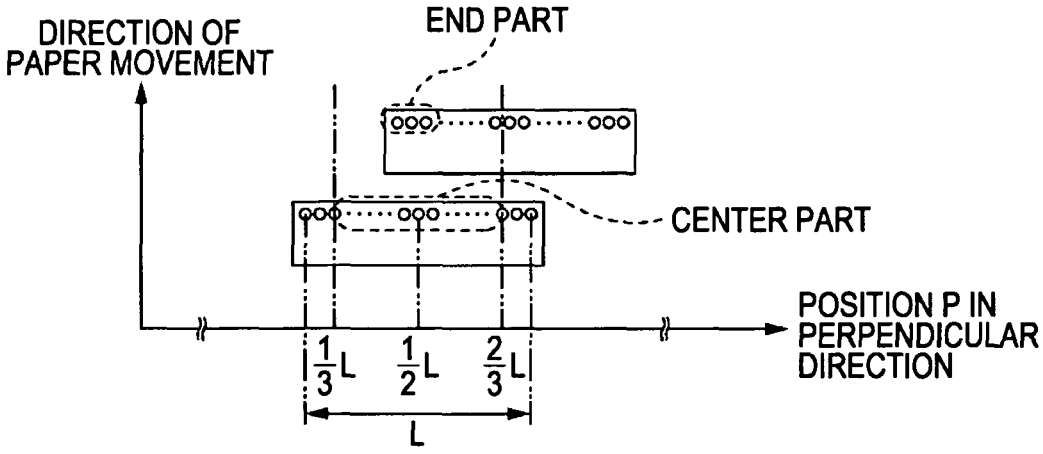
FIG. 12A is a diagram showing disposition of two nozzle arrays according to an embodiment of the invention.

When two nozzle arrays 141 and 141 are arranged, the position of the center part, for example, may be located in a position corresponding to an approximately ⅓ of the length L of the nozzle array 141 or an approximately ⅔ of the length. In other words, the position of the center part may be within the range from a position corresponding to an approximately ⅓ of the length L to a position corresponding to an approximately ⅔ of the length (see FIG. 12A). In any case, the landing fluctuations due to the above-described phenomenon of ejection amount variances are dispersed in the perpendicular direction, compared to the above-described reference example.

Considering the dispersion of the landing fluctuations (particularly, parts in which the ejection amount increases due to the bathtub phenomenon), the landing fluctuations are considered not to be overlapped with each other. For example, FIG. 12B shows an example in which the position of the center part of one nozzle array 141 is set to a position apart from end part by L/4 and the end part of the other nozzle array 141 is disposed in a position deviated from the position of the center part by p/4 in the perpendicular direction in arranging four nozzle arrays 141.

Figure 12B:
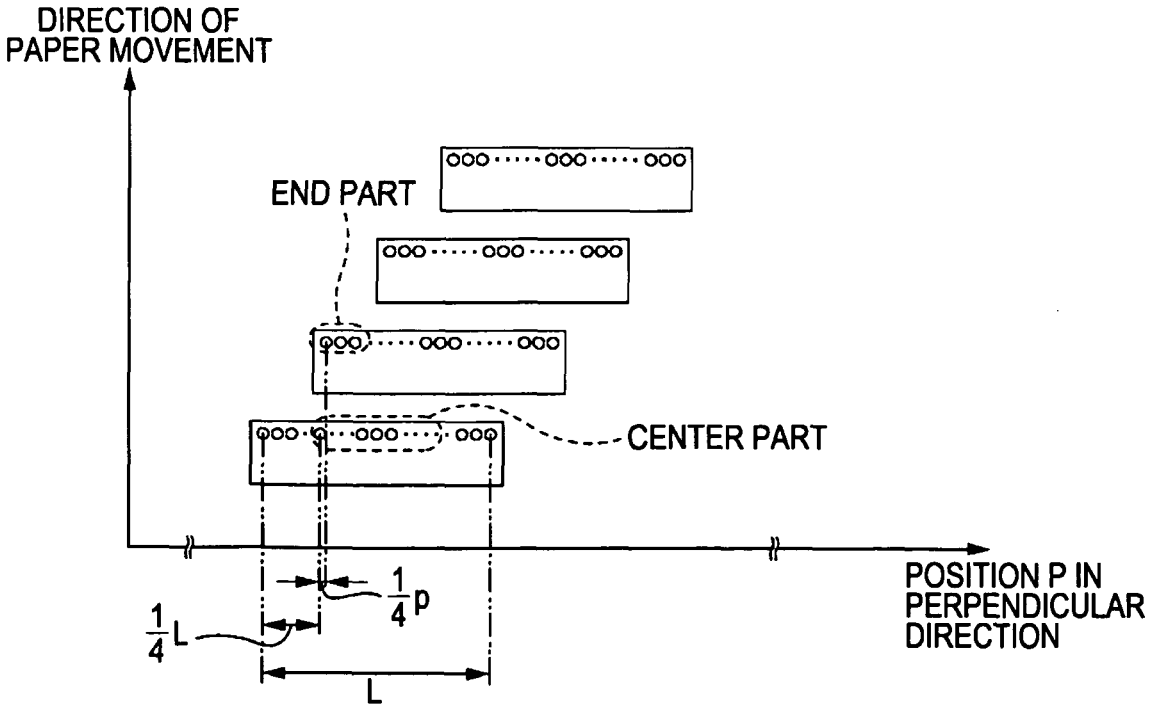
FIG. 12B is a diagram showing disposition of four nozzle arrays according to an embodiment of the invention.

In the example shown in FIG. 12B, a set of nozzle arrays configured by a reference nozzle array (a first nozzle array) that becomes a positional reference and other three nozzle arrays (second nozzle arrays) that eject ink of a same type as that of the reference nozzle array is included. Other nozzle arrays are disposed to be deviated from the reference nozzle array in the direction of paper movement (direction of movement) and the perpendicular direction (intersection direction) such that the end parts of the nozzle arrays are located between one end of the reference nozzle array and the other end. In addition, other nozzle arrays are disposed in positions deviated from the reference nozzle array in the perpendicular direction. For example, the positions of other nozzle arrays are deviated such that the end parts in the perpendicular direction are disposed in positions determined by the length L of the reference nozzle array and the number n (in this example, 4) of the nozzle arrays configuring one set. In other words, in four nozzle arrays forming one set, the end part of the reference nozzle array and end parts of other three nozzle arrays are apart by a gap of ¼ of the length L of the first nozzle array.

As described above, by disposing the nozzle arrays 141 based on the length L of the reference nozzle array and the number n of the nozzle arrays configuring one set, the positions of the end parts of other nozzle arrays in the perpendicular direction are determined to be predetermined positions (in the center part of the reference nozzle array). Accordingly, the landing fluctuations can be configured not to be close from one another in the perpendicular direction of a printed material. In addition, the positions of the landing fluctuations can be dispersed in the perpendicular direction depending on position relationship (a predetermined position) between the end parts and the center part. As a result, the visual distinctiveness of the landing fluctuations in the acquired printed material can be suppressed.

In addition, in the example shown in FIG. 5, the line head is arranged for each color of ink in the line head group 140. Thus, the nozzle arrays 141 that eject ink of a same color are disposed in close positions in the direction of paper movement, and the nozzles arrays 141 that eject ink of different colors are disposed in positions apart from one another in the direction of paper movement. For example, a set of nozzle arrays 141Ya, 141Yb, and 141Yc that eject yellow ink and a set of nozzle arrays 141Ma, 141Mb, and 141Mc that eject magenta ink are apart from each other in the direction of paper movement. However, disposition of the nozzle arrays 141 of the line head group 140 is not limited thereto.

For example, one line head in which the nozzle arrays 141 are disposed such that the positions of both ends of the nozzle array 141Ya ejecting yellow ink and the positions of both ends of the nozzle array 141Ma ejecting magenta ink are adjusted to each other in the perpendicular direction (the intersection direction) is produced, and another line head in which the nozzle arrays 141 are disposed such that the positions of both ends of the nozzle array Yb and the positions of both ends of the nozzle array Mb are adjusted to each other in the perpendicular direction (intersection direction) is produced. Then, one line head group may be configured by combining the above-described line heads. Accordingly, the disposition of the nozzle arrays 141 in producing one line head can be simplified, compared to the example shown in FIG. 5. In addition, when one line head group is configured, the number of the above-described line heads arranged in the perpendicular direction (intersection direction) can be freely adjusted. Accordingly, the range of the width in which ink can be ejected can be freely changed. The nozzle arrays 141 that eject yellow ink and magenta ink have been described as an example. However, the description above can be applied to the nozzle arrays 141 that eject cyan ink or black ink.

Second Embodiment

Next, a second embodiment of the invention will be described. In this embodiment, the basic configuration of the above-described first embodiment is used, and disposition of the nozzle arrays 141 (that is, disposition of the nozzles) is different from that of the first embodiment. Thus, to each configuration that is the same as that of the first embodiment, a same reference sign is assigned, and a description thereof is omitted here.

Figure 13:
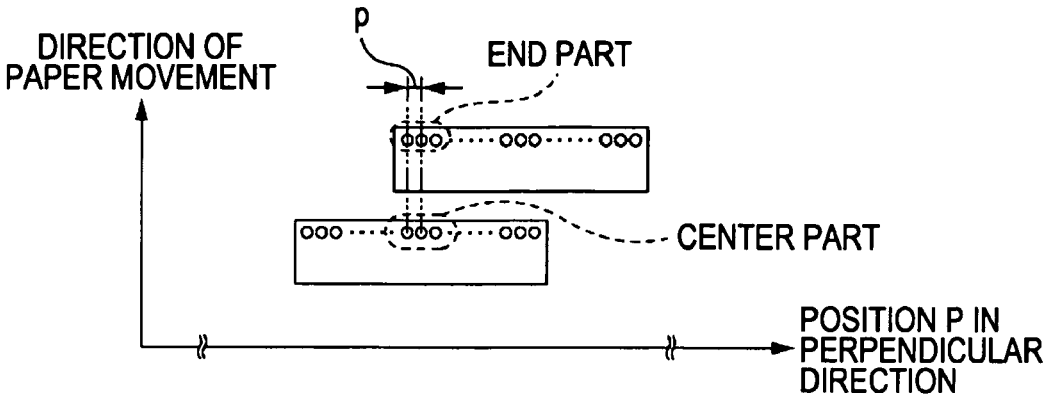
FIG. 13 is a diagram showing an example of disposition of nozzle arrays of a head unit according to a second embodiment of the invention.

In the first embodiment, in order to increase the print resolution for the width direction "a" times (for example, two times), in the line head ejecting ink of one color, between nozzles of one nozzle array that are positioned to be adjacent in the perpendicular direction, nozzles of another nozzle array 141 are disposed. To the contrary, in this embodiment, as an enlarged part is shown in FIG. 13, in the line head that ejects ink of one color, the nozzle arrays are disposed such that the positions of nozzles included in one nozzle array 141 are disposed to be adjusted to the positions of nozzles of another nozzle array 141 in the perpendicular direction. In addition, in this embodiment, the positions of the nozzles in the perpendicular direction are adjusted, and accordingly, the nozzle pitch p of the one nozzle array 141 and the nozzle pitch p of the another nozzle array 141 are the same. In addition, relationship of the center part of one nozzle array 141 between two nozzle arrays 141 and 141 and the end part of the other nozzle array 141 is the same as that of the first embodiment.

Figure 14A:
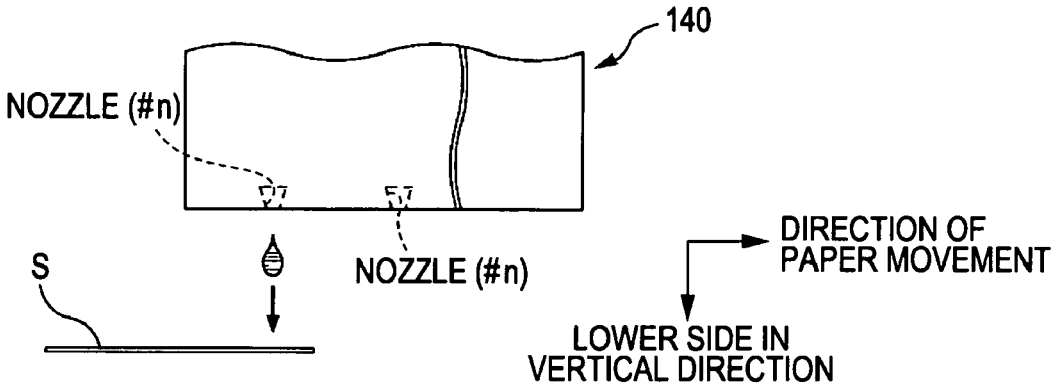
FIG. 14A is a diagram showing control of ink ejection in the disposition of nozzle arrays shown in FIG. 13 and shows a state in which ink droplets are ejected from nozzle arrays disposed on the upstream side in the direction of paper movement.

In the example shown in FIG. 13, the controller 110 controls ink ejection such that ink droplets ejected from two nozzle arrays 141 and 141 of a line head ejecting ink of one color land in two rows on the paper sheet S along the perpendicular direction that is perpendicular to the direction of paper movement. In particular, first, an ink droplet is ejected from a nozzle (an example of a first nozzle) having a nozzle number #n that is included in the nozzle array 141 disposed on the upstream side in the direction of paper movement at a specific timing (see FIG. 14A). Accordingly, the ink droplet lands in the paper sheet S so as to form dots. At this moment, the controller 110 controls ink ejection such that an ink droplet is not ejected from the nozzle array 141 disposed on the downstream side in the direction of paper movement.

Figure 14B:
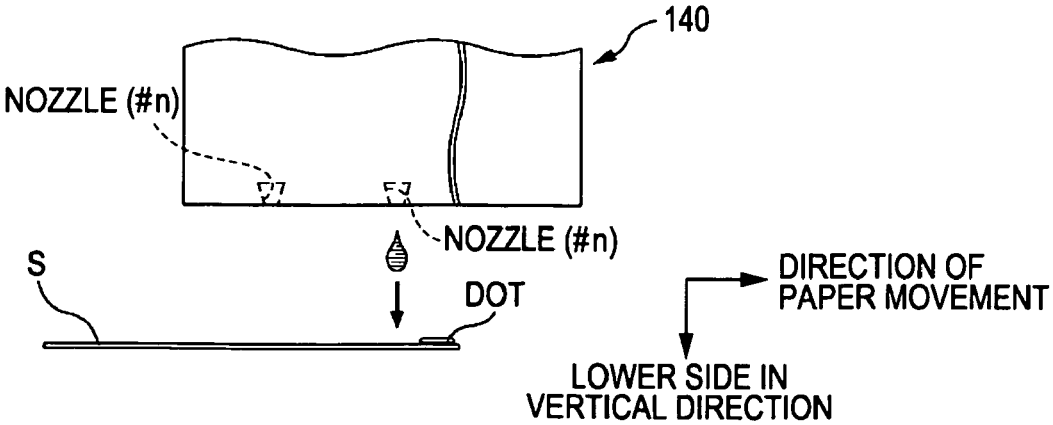
FIG. 14B shows a state in which ink droplets are ejected from nozzle arrays disposed on the downstream side in the direction of paper movement.

At another timing thereafter, the controller 110 ejects an ink droplet from a nozzle (an example of a second nozzle) having a nozzle number #n that is included in the nozzle array 141 disposed on the downstream side in the direction of paper movement (see FIG. 14B). At this moment, the controller 110 controls ink ejection such that an ink droplet is not ejected from the nozzle array 141 disposed on the upstream side in the direction of paper movement. The landing position of the ink droplet ejected at this timing is different from that ejected at the previous timing. The above-described ejection operations are alternately performed. Accordingly, a dot formed by two ink droplets ejected from the nozzles having a same nozzle number #n are arranged in the direction of paper movement (the direction in which the paper sheet S is moved). As a result, the number of times of landing of ink droplets in the row of the paper sheet S along the direction of paper movement for each unit time can increase more assuredly, compared to the first embodiment.

In addition, in this embodiment, the controller 110 sets the speed of movement of the paper sheet S by using the paper moving mechanism 120 higher than that in the first embodiment. For example, as shown in FIG. 13, when there are two nozzle arrays 141, the speed of movement is doubled. On the other hand, when there are "A" nozzle arrays 141, the speed of movement increases by times of "A" that is the same as the number A of the nozzle arrays 141. Accordingly, the print speed can be set to be higher than that of the first embodiment.

According to the second embodiment, the nozzle array 141 that causes the landing fluctuations due to the phenomenon of ejection amount variations changes each time the timing for ink ejection changes. Accordingly, the landing fluctuations can be dispersed also in the direction or paper movement.

In addition, in the second embodiment, print control is performed such that ink droplets ejected from A nozzle arrays 141 land in rows corresponding to the number A of the nozzle arrays 141 disposed along the width direction of the paper sheet S. However, alternatively, print control may be performed such that ink droplets ejected from "A" nozzle arrays 141 land in rows corresponding to a number smaller than the number A of the nozzle arrays 141, for example, one row.

The description above is for one line head (that is, a line head that ejects ink of one color). However, the description may be applied to another line head (a line head that ejects ink of a different color).

In addition, in the above-described embodiment, a case where the two nozzle arrays 141 and 141 have a same configuration has been mainly described. However, the two nozzle arrays 141 and 141 are not needed to have an exactly same configuration. For example, between the two nozzle arrays 141 and 141, the numbers of nozzles, the nozzle pitches p, and the directions of nozzle arrangement of the nozzle arrays 141, the directions of repetition of the nozzle arrays 141, or the like may be slightly different from each other. In addition, the positions of both ends of the two nozzle arrays 141 and 141 that eject ink of different colors are not needed to be completely adjusted in the perpendicular direction to each other and may be slightly different from each other. Even in such a case, the phenomena of the ejection amount variations occur in an equivalent degree due to the ink ejecting mechanism including the nozzle arrays 141, and thus, the same operations and advantages as those of the above-described embodiment are acquired.

Third Embodiment

Figure 15:
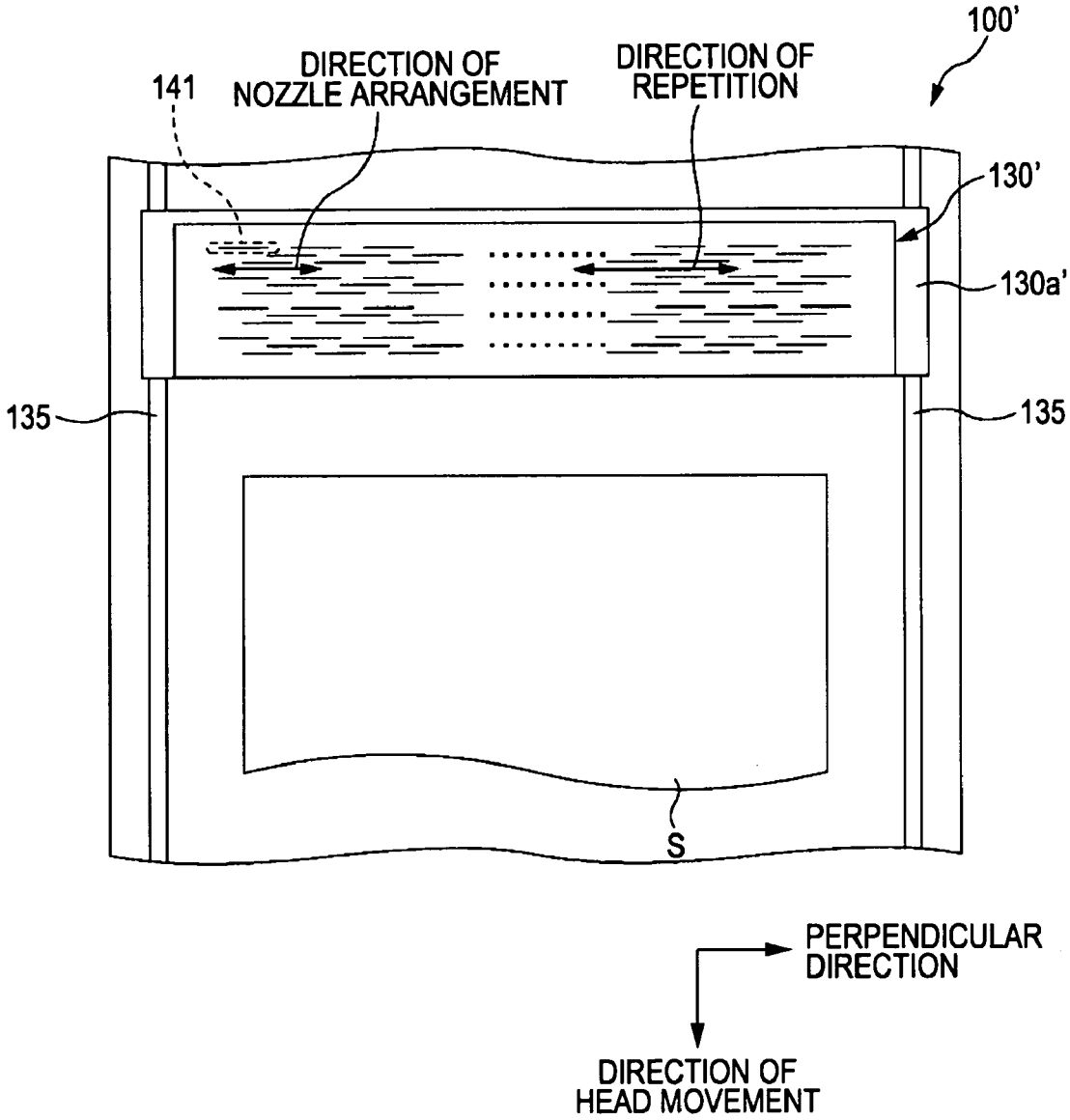
FIG. 15 is a schematic diagram showing the configuration of a printer according to a third embodiment of the invention.

FIG. 15 is a schematic diagram showing the configuration of a printer according to a third embodiment of the invention. In this embodiment, to each configuration that is the same as that in the first embodiment, a same reference sign is assigned, and a description thereof is omitted here.

A printer 100' shown in FIG. 15 includes a head unit 130', a head installation member **130*a*' used for installing the head unit 130', and guide grooves 135 and 135 that guide moving of the head installation member 130*a*'. The head unit 130', differently from that of the printer 100 according to the first embodiment, is configured to be movable in the direction of repetition of the nozzle arrays 141 and a direction of head movement (an example of the movement direction) that intersects with the direction of nozzle arrangement of the plurality of nozzles. In particular, by moving the installation member 130*a*' along the guide grooves 135 and 135, the head unit 130' is moved in the direction of repetition of the nozzle arrays 141 and the direction of head movement that intersects with the direction of nozzle arrangement of the plurality of nozzles. Here, a mechanism (not shown) used for moving the head installation member 130*a*' corresponds to a mechanism for moving the head unit 130', that is, a head moving mechanism, and the mechanism corresponds to a movement mechanism. In this embodiment, a paper sheet S that is an example of a landing target is placed in an area in which ink droplets can be ejected from the head unit 130'**, and the paper sheet S is not moved.

Accordingly, in this embodiment, landing fluctuations are generated in the paper sheet S along the direction of head movement of the head unit 130' (in the first embodiment, landing fluctuations are generated along the direction of paper movement of the paper sheet S). However, also in this embodiment, by employing the disposition of the nozzle arrays 141 described in the first and second embodiments, visual distinctiveness of the landing fluctuations can be suppressed.

Fourth Embodiment

Figure 16A:
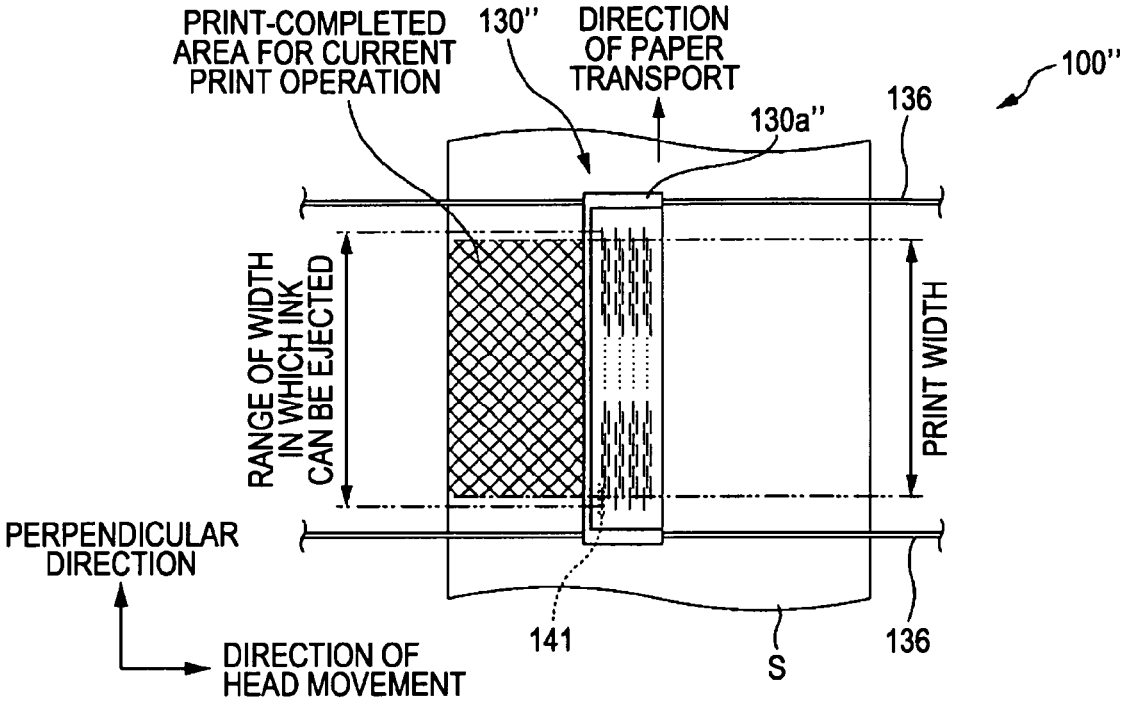
FIG. 16 is a schematic diagram showing the configuration of a printer according to a fourth embodiment of the invention.
Figure 16B:
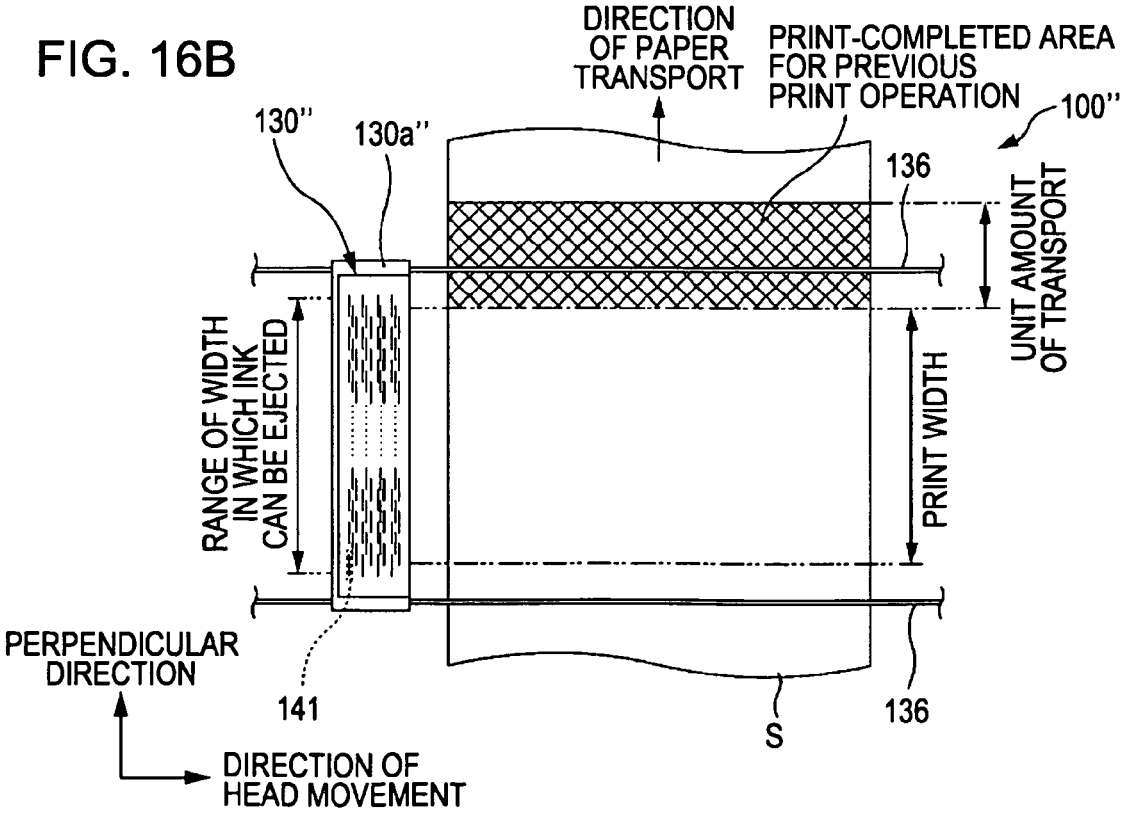

FIGS. 16A and 16B are schematic diagrams showing the configuration of a printer according to a fourth embodiment of the invention. In this embodiment, to each configuration that is the same as that in the first embodiment, a same reference sign is assigned, and a description thereof is omitted here.

A printer 100" shown in FIG. 16A includes a head unit 130", a head installation member **130*a*" used for installing the head unit 130", and guide shafts 136 and 136 that guide moving of the head installation member 130*a*". In the printer 100", by moving the head installation member 130*a*" along the guide shafts 136 and 136, the head unit 130" is configured to be moved in the direction of repetition of the nozzle arrays 141 and a direction of head movement (an example of the movement direction) that intersects with the direction of nozzle arrangement of the plurality of nozzles. Thus, a mechanism (partially not shown) used for moving the head installation member 130*a*" corresponds to a head moving mechanism for moving the head unit 130"**. In addition, the head moving mechanism is an example of the movement mechanism.

In addition, the printer 100" includes a paper transporting mechanism (not shown) that transports the paper sheet S that is an example of the landing target in a paper transporting direction that intersects with the direction of head movement. In this printer 100", the paper transporting direction is the same as the perpendicular direction that is perpendicular to the direction of head movement. Accordingly, a print operation for a paper sheet S having a size larger than an area in which ink droplets can be ejected from the head unit 130" can be performed.

In addition, the printer 100", includes a controller that controls the head unit 130", the head moving mechanism, and the paper transporting mechanism.

The controller performs a head moving and ink ejecting operation for ejecting ink that is an example of a liquid from nozzles of the head unit 130" with the head unit 130" moved in the direction of head movement and a paper transporting operation for transporting the paper sheet S in the paper transporting direction by a transport amount defined within the range of the width in which ink can be ejected from the nozzles included in the head unit 130". Here, the head moving and ink ejecting operation is an example of a movement and ejection operation, and the paper transporting operation is an example of a transport operation.

In particular, when the head moving and ink ejecting operation is performed by the controller 110, ink droplets land in the paper sheet S. At this moment, an area (a print-completed area for the current print operation shown in FIG. 16A) in which a print operation is completed is formed on the paper sheet S in accordance with the movement amount of the head unit 130" and the print width. Here, the print width is an area within the range of the width in which ink can be ejected and is defined in a range excluding a range in which the nozzle arrays 141 are not overlapped in the perpendicular direction that is perpendicular to the direction of head movement.

Then, when a print operation for the paper sheet S in the width direction that is perpendicular to the paper transporting direction is completed, the head unit 130" retreats to a predetermined standby position as shown in FIG. 16B. Thereafter, a paper transporting operation is performed. Accordingly, a print-completed area (an area shown in FIG. 16B for which the previous print operation has been completed) for the previous print operation is also moved in the paper transporting direction. At this moment, the paper sheet S is transported in the paper transporting direction by the amount of paper transport corresponding to the print width. Here, since the print width is determined based on the range of the width in which ink can be ejected and the length of the nozzle array 141 in the perpendicular direction, the print width has a fixed value. Accordingly, the amount of paper transport is fixed and corresponds to a unit transport amount.

By alternately performing the head moving and ink ejecting operation and the paper transporting operation, ink can land in the entire paper sheet S that can face the nozzle face of the head unit 130". In addition, by transporting the paper sheet S by a predetermined amount of paper transport, overlap of the ranges of the widths in which ink can be ejected is prevented.

In this embodiment, the landing fluctuations are generated in the paper sheet S along the direction of head movement for the head unit 130". However, also in this embodiment, by employing the disposition of the nozzle arrays 141 described in the first and second embodiments, visual distinctiveness of the landing fluctuations can be suppressed. In addition, in this embodiment, since the head moving and ink ejecting operation is not performed during the paper transporting operation, the landing fluctuations are not generated along the paper transporting direction for the paper sheet S.

Fifth Embodiment

In each of the above-described embodiments, when two nozzle arrays are configured as one set (when the number n of nozzle arrays that configure one set is "2"), the position of the other nozzle array (a second nozzle array) is determined such that the end part of the other nozzle array is located in the center part of the reference nozzle array (a first nozzle array) that becomes a positional reference. In other words, the position in which the other nozzle array is located is determined such that the end part of the other nozzle array is disposed at an interval of ½ from the end part of the reference nozzle array that becomes the positional reference. In addition, when four nozzle arrays are configured as one set (when the number n of nozzle arrays that configure one set is "4"), the positions in which other nozzle arrays are located are determined such that end parts of other nozzle arrays are disposed at intervals of ¼ from the end part of the reference nozzle array that becomes the positional reference.

As described above, in each of the above-described embodiments, the position of each nozzle array is determined by using the end part of each nozzle array as a reference. Here, the positional reference is not limited to the end part of the nozzle array. For example, the center of each nozzle array may be used as the reference. Hereinafter, a fifth embodiment of the invention in which the above-described reference is used will be described.

Figure 17:
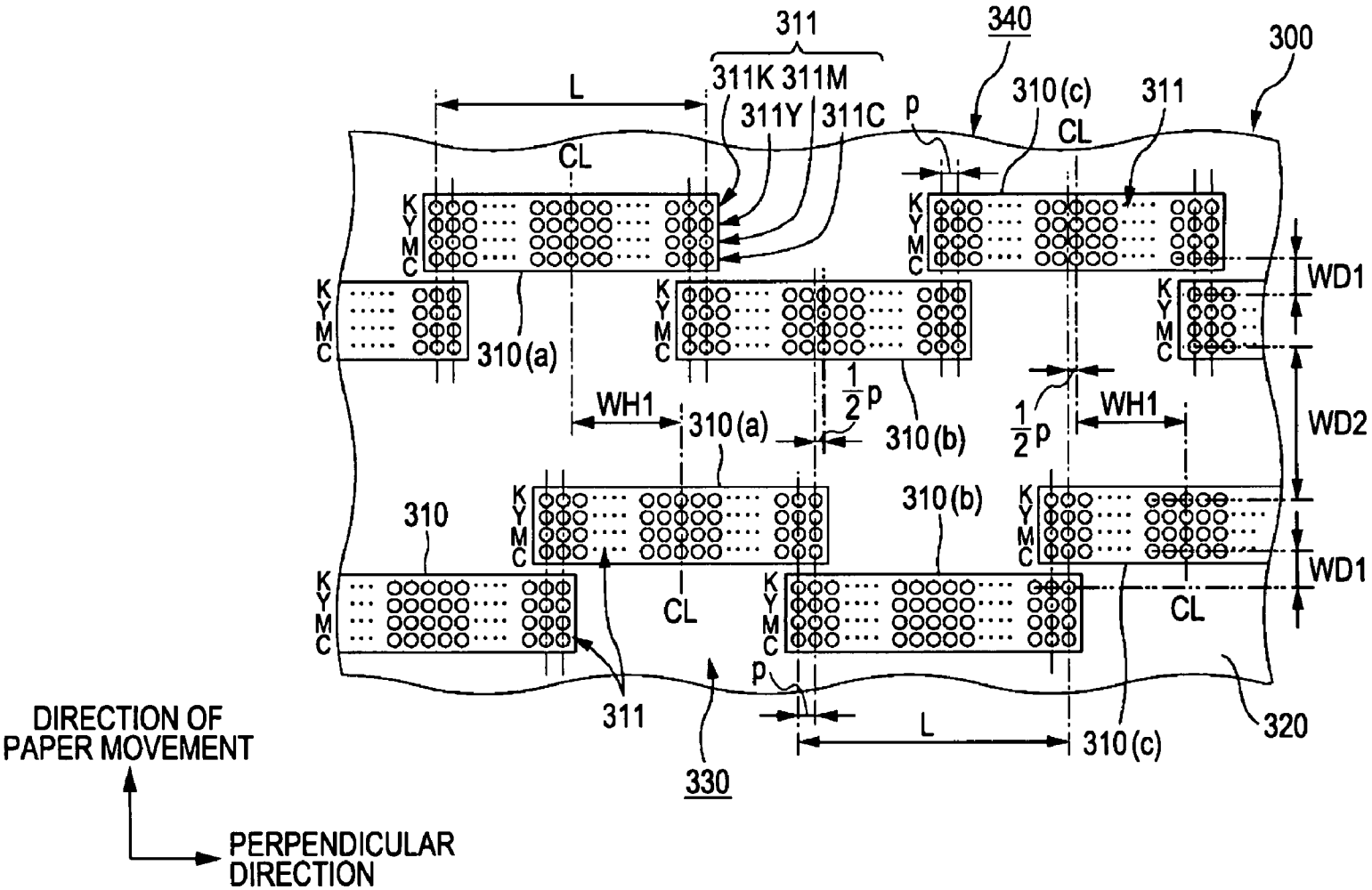
FIG. 17 is a diagram showing disposition of nozzle arrays according to a fifth embodiment of the invention.
Figure 18:
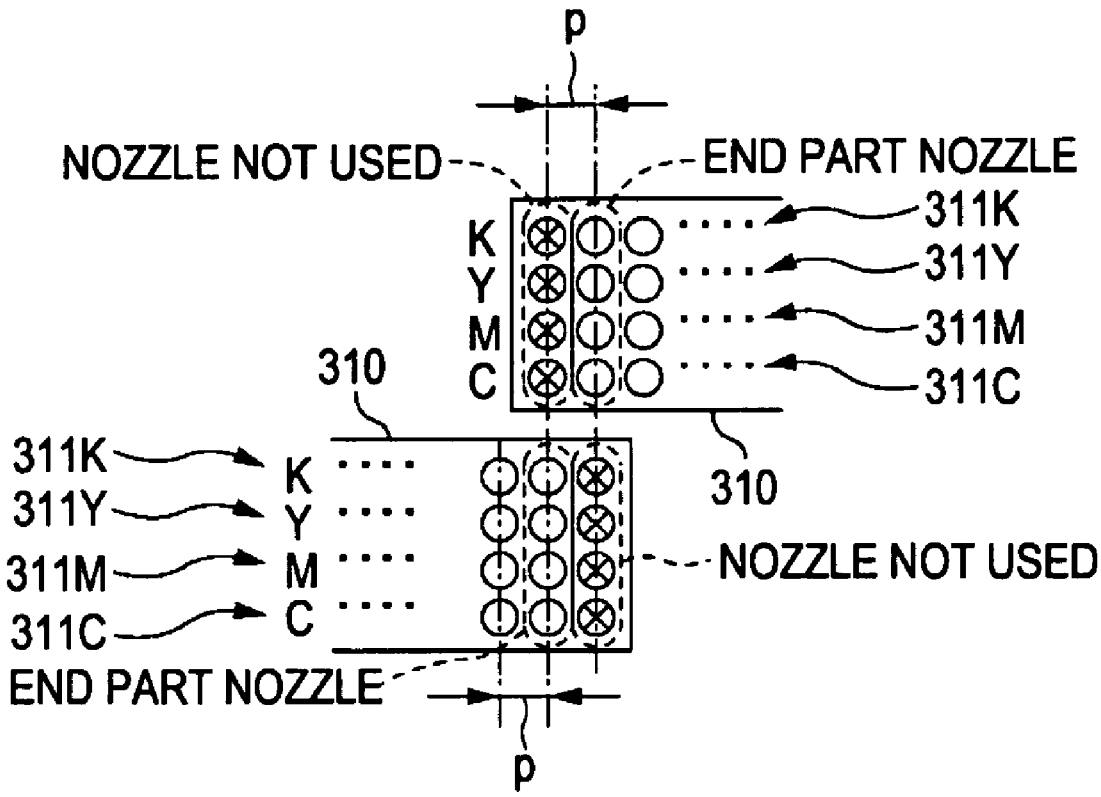
FIG. 18 is a diagram showing nozzles disposed in end parts of the nozzle arrays shown in FIG. 17.

FIGS. 17 and 18 are diagrams showing the fifth embodiment. FIG. 17 is a diagram of a part of a line head 300 viewed from the nozzle side. FIG. 18 is a diagram showing nozzles disposed in the end parts of the nozzle arrays. This line head 300 is used instead of the above-described line head group 140. Thus, other configurations of the printers 100, 100', and 100" are the same as those of the above-described embodiments, and a description thereof is omitted here.

The line head 300 according to the fifth embodiment includes a plurality of head main bodies 310 and a base plate 320. In the head main body 310, a nozzle array group 311 is disposed. The nozzle array group 311 is configured by a plurality of nozzle arrays that eject ink of different types. The exemplified nozzle array group 311 includes a black ink nozzle array 311K that ejects black ink, a yellow ink nozzle array 311Y that ejects yellow ink, a magenta ink nozzle array 311M that ejects magenta ink, and a cyan ink nozzle array 311C that ejects cyan ink.

As in each of the above-described embodiments, each nozzle array 311K, 311Y, 311M, or 311C has a plurality of nozzles arranged at a predetermined pitch in the direction of arrangement. For example, each nozzle array has 180 nozzles that are arranged at a pitch of 1/180 inch. Accordingly, the length L of each nozzle array 311K, 311Y, 311M, or 311C becomes one inch. Here, the nozzle arrays 311K, 311Y, 311M, and 311C are parallel to one another and have a same number of nozzles and a same nozzle pitch. In addition, the positions of nozzles located on both end parts are the same. In particular, among nozzles located in one end part of each nozzle array 311K, 311Y, 311M, or 311C or among nozzles located in the other end part thereof, the positions on the bottom face (nozzle face) of the head main body 310 in the longitudinal direction are adjusted to one another.

The head main bodies 310 configure a preceding head group 330 and a following head group 340 in a state that head main bodies are attached to the base plate 320. The preceding head group 330 is a head group that performs ejection of ink droplets for the paper sheet S first and is disposed on the upstream side of the following head group 340 in the direction of paper movement. In addition, the following head group 340 is a head group that performs ejection of ink for the paper sheet S afterwards and is disposed on the downstream side of the preceding head group 330 in the direction of paper movement.

The head main bodies 310 belonging to the preceding head group 330 are disposed in a zigzag pattern along the perpendicular direction. Here, attaching positions of the head main bodies 310 are determined such that nozzles are disposed at a predetermined nozzle pitch p in the perpendicular direction. In this embodiment, for example, as shown in FIG. 18, positions of two endmost nozzles of each nozzle arrays 311K, 311Y, 311M, or 311C are adjusted in the perpendicular direction. In addition, a nozzle located in the end of each nozzle array 311K, 311Y, 311M, or 311C is set as a non-used nozzle and is configured not to eject ink droplets. Accordingly, in this embodiment, nozzles located second from the ends of the nozzles arrays 311K, 311Y, 311M, and 311C become the endmost nozzles (end part nozzles) that can eject ink droplets.

The head main bodies 310 belonging to the following head group 340 are also disposed in a zigzag pattern along the perpendicular direction. In addition, attaching positions of the head main bodies 310 are determined such that nozzles are disposed at a predetermined nozzle pitch p in the perpendicular direction. In addition, nozzles located in the ends of the nozzle arrays 311K, 311Y, 311M, and 311C are non-used nozzles, and nozzles located second from the ends of the nozzle arrays are end part nozzles.

The head main bodies 310 configuring the following head group 340 are attached to positions deviated from the head main bodies 310 configuring the preceding head group 330 in the perpendicular direction (an example of the intersection direction) by a half of the length L of the nozzle arrays. In particular, in order to form dots between dots, which are formed by the preceding head group 330, by using the following head group 340, nozzles belonging to the following head group 340 are disposed to be located between nozzles of the preceding head group 330 which are adjacent to each other in the perpendicular direction. By configuring as described above, a print operation with high resolution can be performed, compared to a case where the print operation is performed only by the preceding head group 330.

Referring to the nozzle arrays, a nozzle array (a reference nozzle array that becomes a positional reference and an example of the first nozzle array) belonging to the preceding head group 330 and another nozzle array (an example of the second nozzle array) that belongs to the following head group 340 and forms one set with the nozzle array are disposed in positions deviated from each other in the direction of paper movement. In addition, the another nozzle array is disposed in a position deviated from the nozzle array in the perpendicular direction such that the center CL of the another nozzle array is apart from the center CL of the nozzle array in the perpendicular direction by a distance WH1 that is a half of the length L of the nozzle array.

In this example, two head main bodies denoted by reference symbol 310(*a*) forms one set. Similarly, two head main bodies denoted by reference symbol 310(*b*) and two head main bodies denoted by reference symbol 310(*c*) form one set, respectively. Thus, each nozzle array 311K, 311Y, 311M, or 311C that is disposed in the head main body 310(*a*) of the preceding head group 330 and each nozzle array 311K, 311Y, 311M, or 311C that is disposed in the head main body 310(*a*) of the following head group 340 form one set. Similarly, the nozzle arrays 311K, 311Y, 311M, or 311C included in the head main bodies 310(*b*), the head main bodies 310(*c*), and other head main bodies 310 respectively form one set.

As described above, in the line head 300, another nozzle array is disposed in a position deviated from a nozzle array such that the center CL of a nozzle array that forms one set with the another nozzle array and the center CL of the another nozzle array are apart in the perpendicular direction by a distance WH1. Accordingly, the same operations and advantages as those of the above-described embodiments are acquired. In other words, the landing fluctuations generated by the phenomenon of ejection amount variations can be dispersed in the perpendicular direction, and accordingly, the landing fluctuations can be configured not to be visually distinctive.

In addition, in the line head 300, the head main bodies 310 belonging to the preceding head group 330 can be divided into an upstream side group that is disposed on the upstream side in the direction of paper movement and a downstream side group that is disposed on the downstream side in the direction of paper movement. Similarly, the head main bodies 310 belonging to the following head group 340 can be divided into an upstream side group and a downstream side group. In addition, a gap (a gap between the nozzle array that is located on the most downstream side of the upstream side group and the nozzle array that is located on the most upstream side of the downstream side group) between the upstream side group and the downstream side group of the preceding head group 330 and a gap between the upstream side group and the downstream side group of the following head group 340 are the same as denoted by reference sign WD1. To the contrary, a gap between the head main body 310 belonging to the preceding head group 330 and the head main body 310 belonging to the following head group 340, as denoted by reference sign WD2, is sufficiently larger than the gap WD1 between the upstream side group and the downstream side group. Accordingly, at a timing for forming dots by using the following head group 340, dots formed by using the preceding head group 330 can be dried, and thereby blurring of an image can be prevented.

Modified Example

Figure 19:
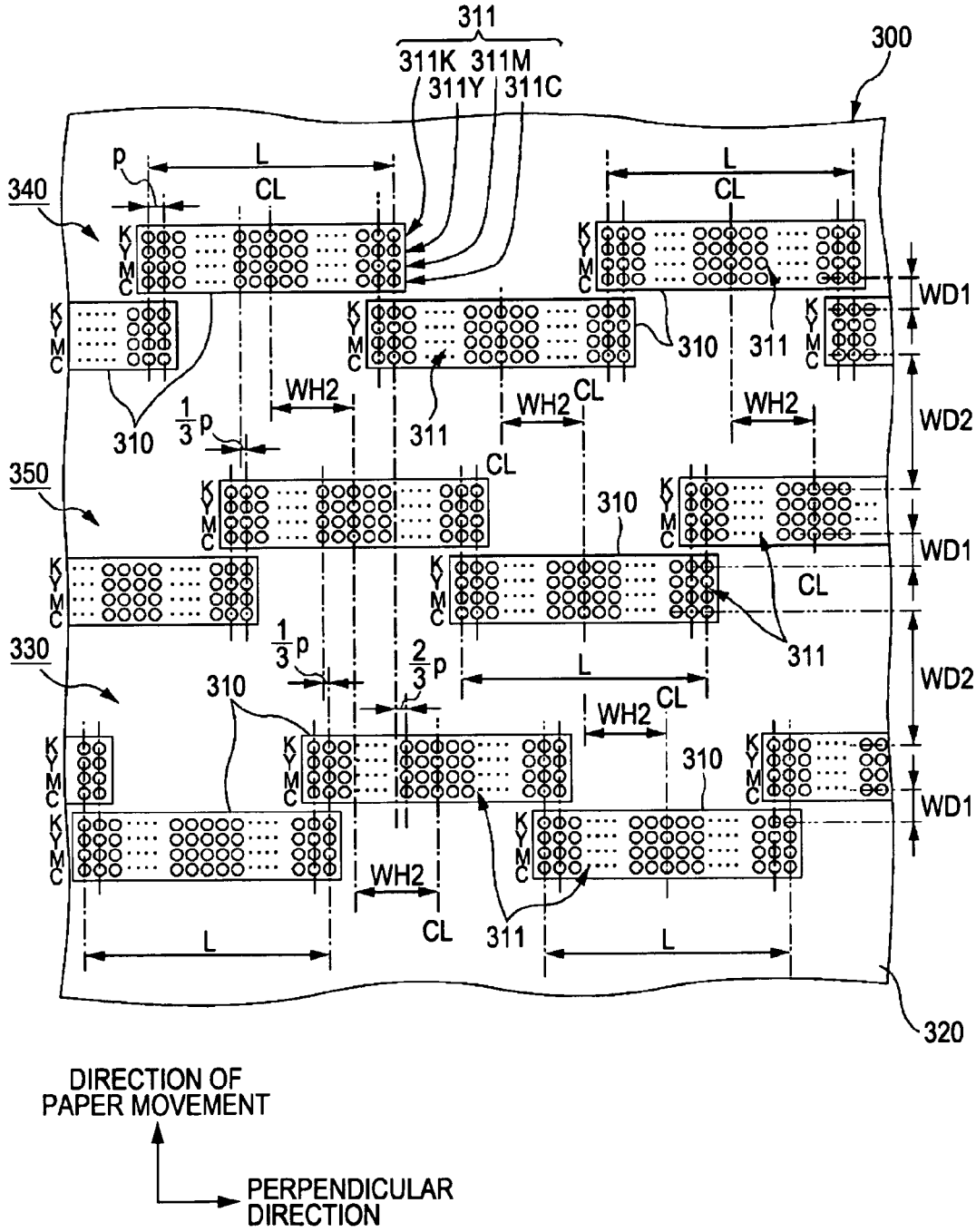
FIG. 19 is a diagram showing disposition of nozzle arrays according to a modified example of the fifth embodiment.

FIG. 19 is a diagram showing a modified example of the fifth embodiment. A big difference between the fifth embodiment and the modified example is that an intermediate head group 350 is disposed between the preceding head group 330 and the following head group 340 in this modified example. In other words, in a line head 300 according to the modified example, three nozzle arrays including a nozzle array included in the head main body 310 of the preceding head group 330, a nozzle array included in the head main body 310 of the intermediate head group 350, and a nozzle array included in the head main body 310 of the following head group 340 form one set.

Accordingly, the head main bodies 310 configuring the intermediate head unit 350 are attached to positions deviated from the head main bodies 310 configuring the preceding head group 330 by ⅓ of the length L of the nozzle array in the perpendicular direction (an example of the intersection direction). Similarly, the head main bodies 310 configuring the following head group 340 are attached to positions deviated from the head main bodies configuring the intermediate head group 350 by ⅓ of the length L of the nozzle array in the perpendicular direction. In other words, the head main bodies 310 configuring the following head unit 340 are attached to positions deviated from the head main bodies 310 configuring the preceding head group 330 by ⅔ of the length L of the nozzle array in the perpendicular direction.

Referring to the nozzle arrays, a nozzle array (a reference nozzle array that becomes a reference and an example of the first nozzle array) belonging to the preceding head group 330 and another nozzle array (an example of the second nozzle array) that belongs to the intermediate head group 350 and forms one set with the nozzle array are disposed in positions deviated from the nozzle array in the perpendicular direction such that the center CL of the another nozzle array is apart from the center CL of the nozzle array in the perpendicular direction by a distance WH2 that is ⅓ of the length L of the nozzle array. Similarly, another nozzle array (an example of the second nozzle array) belonging to the following head group 340 and forms one set with the nozzle array are disposed in positions deviated from the nozzle array in the perpendicular direction such that the center CL of the another nozzle array is apart from the center CL of the nozzle array in the perpendicular direction by a distance (WH2+WH2) that is ⅔ of the length L of the nozzle array.

In addition, each nozzle belonging to the intermediate head group 350 is disposed in a position deviated from each nozzle belonging to the preceding head group 330 in the perpendicular direction by ⅓ of the nozzle pitch. In addition, each nozzle belonging to the following head group 340 is disposed in a position deviated from each nozzle belonging to the intermediate head group 350 in the perpendicular direction by ⅓ time the nozzle pitch and is disposed in a position deviated from each nozzle belonging to the preceding head group 330 in the perpendicular direction by ⅔ of the nozzle pitch. Accordingly, dots can be formed between dots that are formed by using the preceding head group 330 by using the intermediate head group 350 and the following head group 340, and thereby a print operation with high resolution can be performed, compared to a case where the print operation is performed only by the preceding head group 330.

As described above, in the line head 300 according to the modified example, another nozzle array is located in a position deviated from a nozzle array in the perpendicular direction such that the center CL of the another nozzle array belonging to the intermediate head group 350 or the following head group 340 is apart from the center CL of the nozzle array belonging to the preceding head group 330 by a distance determined as 1/n of the length L of the nozzle array. Accordingly, the same operations and advantages as those of the above-described embodiments are acquired.

Other Embodiments

Although the printers according to the above-described embodiments have been described, in the above-described embodiments, disclosure of a print device, a printing method, a liquid ejecting device, a liquid ejecting method, a control program (program code), a head unit, a manufacturing method, and the like are included.

In addition, the above-described embodiments are for the purpose of easy understanding of the invention and are not for the purpose of limiting the invention. It is apparent that the invention may be changed or modified without departing from the gist thereof and includes an equivalent thereof. In particular, the invention includes embodiments described below.

Nozzle Plate 143

Figure 20:
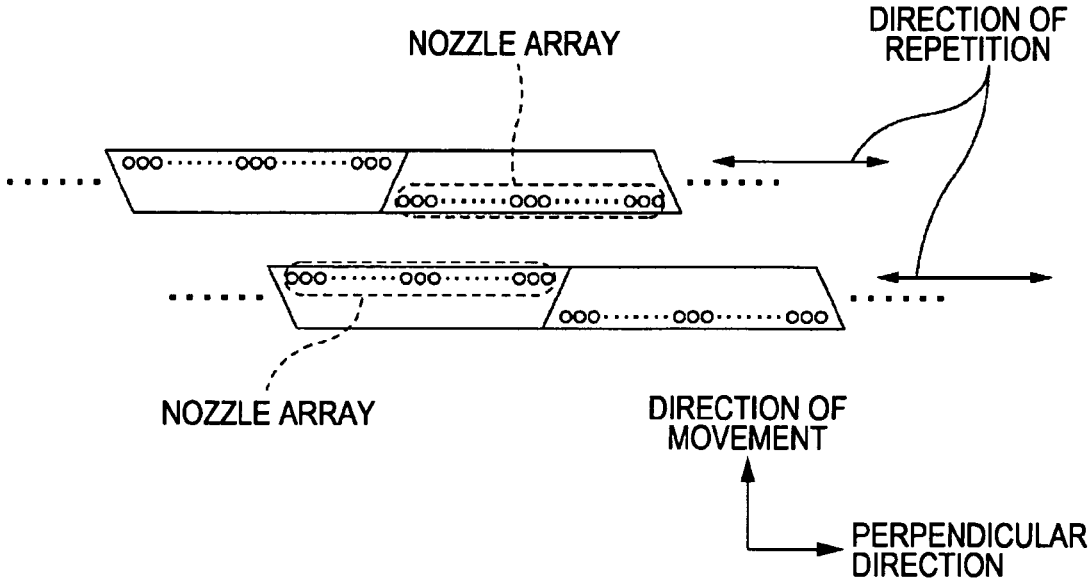
FIG. 20 is a diagram showing a modified example of a nozzle plate shown in FIG. 5.

In the above-described embodiments, the shape of the nozzle plate 143 is not limited to a rectangle (see FIG. 5). For example, the shape of the nozzle plate may be an approximate trapezoid as shown in FIG. 20. By forming the shape of the nozzle plate as an approximate trapezoid and alternating the positions of the nozzle arrays to be formed in two nozzle plates having adjacent disposition positions as shown in FIG. 20, the disposition of the nozzle arrays described in the first or second embodiment can be implemented without arranging a gap between the nozzle plates. In addition, the above-described approximate trapezoid includes a form in which one or more level differences are arranged on at least one side. By arranging the level difference, a deviation of the nozzle plates in the direction of paper movement is prevented when the nozzle plates are disposed, in particular, when the nozzle plates are disposed without arranging a gap between the nozzle plates. As a result, the nozzle plates can be fixed to predetermined positions in an easy manner.

Movement Direction

In the above-described first and second embodiments, only the paper sheet S that is a landing target is moved. In addition, in the above-described third embodiment, only the head unit 130' is moved. However, both the landing target and the head unit may be moved by combining the first or second embodiment and the third embodiment. In such a case, the landing target and the head unit are relatively moved in a relative movement direction that intersects with the nozzle arrays 141. This relative movement direction is an example of the movement direction.

Nozzle Pitch p

In each of the above-described embodiments, the nozzle pitches p of the plurality of the nozzle arrays 141 may be configured to be different from one another. However, it is preferable that the nozzle pitches p are equivalent as possibly as can be. Accordingly, the side on which the phenomenon of ejection amount variations due to the ink ejecting mechanism including one nozzle array 141 occurs and the side on which the phenomenon of ejection amount variations due to the ink ejecting mechanism including the other nozzle array 141 occurs can be configured to be close.

Number n of Nozzles

In each of the above-described embodiments, the plurality of the nozzle arrays 141 may have different numbers of nozzles. However, it is preferable that the numbers of the nozzles are equivalent. Accordingly, the side on which the phenomenon of ejection amount variations due to the ink ejecting mechanism including one nozzle array 141 occurs and the side on which the phenomenon of ejection amount variations due to the ink ejecting mechanism including the other nozzle array 141 occurs can be configured to be close.

Direction of Nozzle Arrangement

In each of the above-described embodiments, the direction of nozzle arrangement has been described to be the same as the perpendicular direction that is perpendicular to the movement direction that is the direction of paper movement or the direction of head movement. However, the direction of nozzle arrangement may be different from the perpendicular direction. When the direction of nozzle arrangement is the same as the movement direction, the landing fluctuations are not generated along the movement direction, and thus, such a case is excluded. In other words, the direction of nozzle arrangement may be set to any direction as long as the direction intersects with the movement direction.

In addition, the plurality of the nozzle arrays 141 has been described to have equivalent directions of nozzle arrangement. However, the directions of nozzle arrangement may be different from one another. Accordingly, the side on which the phenomenon of ejection amount variations due to the ink ejecting mechanism including one nozzle array 141 occurs and the side on which the phenomenon of ejection amount variations due to the ink ejecting mechanism including the other nozzle array 141 occurs can be configured to be close.

Direction of Repetition

In each of the above-described embodiments, the plurality of the nozzle arrays 141 disposed in the head units 130, 130', and 130" has been described to be arranged in the direction of repetition. However, the plurality of the nozzle arrays may not be repeatedly arranged. In other words, the head unit may be configured to have two nozzle arrays. In such a case, a part of the phenomenon (bathtub phenomenon) of ejection amount variations that occurs in two nozzle arrays 141 and 141 is dispersed outside the range of the print width. As a result, only a part of the phenomenon of ejection amount variations is reflected on the range of the print width, and accordingly, visual distinctiveness of the landing fluctuations can be suppressed.

In addition, the direction of repetition may not be the same as the direction of nozzle arrangement. In such a case, the direction of repetition is set to a direction that intersects with the direction of nozzle arrangement. However, both the direction of repetition and the direction of nozzle arrangement are set to directions that intersect with the movement direction such as the direction of paper movement.

Position P in Perpendicular Direction

In each of the above-described embodiments, in order to determine the positions of the plurality of the nozzle arrays 141 and the positions of the nozzles, the perpendicular direction is defined, and the position P in the perpendicular direction is considered. However, a direction to be defined may not the perpendicular direction. In such a case, by defining an intersection direction that intersects with the movement direction such as the direction of paper movement or the direction of head movement, the positions of the plurality of the nozzle arrays 141 and the positions of the nozzles can be determined. Thus, as described above, the perpendicular direction is an example of the intersection direction.

Ink Ejecting Mechanism 142

In each of the above-described embodiments, as an element that is included in the ink ejecting mechanism 142 and performs an ejection operation for ejecting ink droplets, the piezo element 142*a* has been exemplified. However, the element is not limited to the piezo element 142*a* and, for example, may be a heating element. The piezo element 142*a* or the heating element generates a pressure change in the ink, and thus, the above-described phenomenon of ejection amount variations may easily occur due to a problem of the ink flow (see arrows B and C shown in FIG. 4) that is generated in accordance with the pressure change or the like. In addition, when the phenomenon of ejection amount variations of ink does not depend on the pressure change of the ink, instead of the ejection mechanism having the piezo element 142*a*, an ejection mechanism having a magnetostrictor or an ejection mechanism having an electrostatic element may be used.

Ink Receiving Member 150

Figure 21:
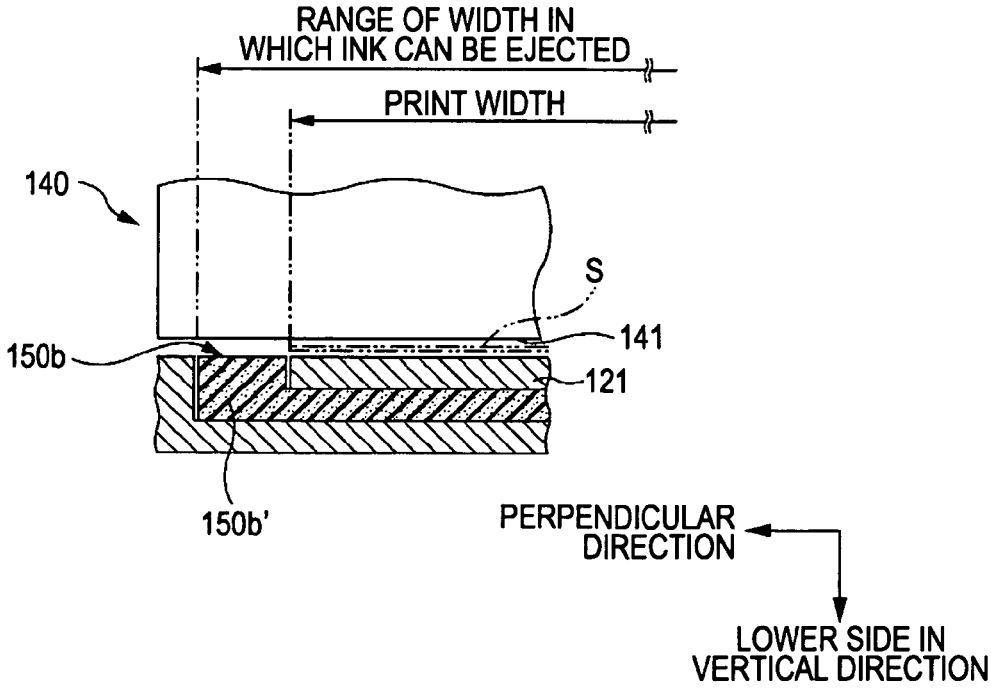
FIG. 21 is a diagram showing a modified example of the ink receiving member shown in FIG. 3.

The ink receiving member 150, in the example shown in FIG. 3, is disposed on the head unit 130 (the nozzle face of the line head group 140) side. However, the ink receiving member may be disposed on the platen 121 side (see FIG. 21). In the example shown in FIG. 21, the ink receiving member 150 is configured by the sponge 150*b*', and the sponge 150*b*' is disposed outside the range of the print width and within the range of the width in which ink can be ejected so as to face the nozzle array 141. In addition, when the head unit 130 is moved (see FIGS. 15 and 16) or both the head unit and the paper sheet S are moved (including being transported), it is preferable that the ink receiving member 150 is disposed in a space between the platen 121 and the line head group 140 which is located on the head unit 130 side.

Ink

In each of the above-described embodiments, the ink of four colors has different systems of ink supplying paths and different colors, and thus ink of each color has been described as an example of a liquid of one type. However, ink of a same color may flow in the ink supplying paths of different systems. For example, ink supplying paths of two systems may be arranged for black ink. In such a case, although the colors are the same, ink flowing through the ink supplying path of one system corresponds to a liquid of one type, and ink flowing though the ink supplying path of a different system corresponds to a liquid of a different type. The reason is that, when the systems of the ink flowing paths are different, the ratio of the amounts of ejection for the systems and the ratio of the amounts of ejection in the entire systems can be considered as shown in FIGS. 9A to 9D.

Printer 100, 100', and 100"

The printers 100, 100', and 100" according to the above-described embodiments can perform a full-color print operation using ink of four colors. However, the invention may be applied to a printer that can perform a monochrome print operation by using monochrome ink. However, by using ink of a plurality of colors, the number of printable colors can increase.

Liquid Ejecting Device

In each of the above-described embodiments, printers 100, 100', and 100" in which the liquid to be ejected from the nozzle is ink has been described. However, the liquid (fluid) to be ejected from the nozzle is not limited to the ink and may be dye, pigment, process liquid, water, oil, a mixture thereof, or the like. In other words, the invention is not applied only to a printer and may be applied to any liquid ejecting device that ejects a liquid. As examples of the liquid ejecting device, there are a printing device, a semiconductor manufacturing device, a display manufacturing device, and a micro array manufacturing device (DNA chip manufacturing device).

Head Unit

In addition, the head unit used in the liquid ejecting device belongs to the invention. In other words, even when a head unit is used as a single body, there are problem that are the same as the above-described problems described in "Related Art". Accordingly, among head units that are manufactured so as to be moved relative to the landing target such as a paper sheet S and eject a liquid such as ink, a head unit that employs the disposition of the nozzle arrays 141 described in the first or second embodiment belongs to the invention.

Number of Nozzle Arrays Forming One Set

The number n of the nozzle arrays that form one set is two in the fifth embodiment and is three in the modified example. In addition, in the first embodiment, a configuration of four nozzle arrays also has been described as an example. As can be known from these, the number n of the nozzle arrays that form one set may be arbitrary set. In addition, the positions of other nozzle arrays in the intersection direction are determined based on the number n of the nozzle arrays that form one set and the length L of the nozzle array.

Above embodiment, as shown in FIG. 18, positions of two endmost nozzles of each nozzle arrays 311K, 311Y, 311M, or 311C are adjusted in the perpendicular direction. In addition, a nozzle located in the end of each nozzle array 311K, 311Y, 311M, or 311C is set as a non-used nozzle and is configured not to eject ink droplets. Accordingly, in this embodiment, nozzles located second from the ends of the nozzles arrays 311K, 311Y, 311M, and 311C become the endmost nozzles (end part nozzles) that can eject ink droplets.

However, as modified embodiment of FIG. 18, the two nozzles of each nozzle arrays 311 (right nozzles array 311 of FIG. 18 and left nozzle array 311 of FIG. 18) that positions are adjusted in the perpendicular direction may be set as a used nozzle and be configured to eject ink droplets. In this case the two nozzles of nozzles arrays 311 which positions are adjusted in the perpendicular direction, eject the ink droplets on one row along the direction in which the paper sheet S is moved. Also in this case, the nozzles located second from the ends of the nozzles arrays 311 become the endmost nozzles. Therefore the two nozzles are not count redundantly as the length of the nozzle array.

In these embodiments, in the case of these nozzles of the nozzle arrays are thought that these are arranged along the perpendicular direction with equal nozzle pitch and the positions of the nozzles are not adjusted in perpendicular direction, substantial edge nozzles of each nozzle arrays (the second nozzle from edge in FIG. 18) is thought as edge nozzle and a length between substantial edge nozzles is thought as the length of the nozzle array. That is the length of effective nozzle array.

The number of nozzles that positions are arranged in the perpendicular direction is not limited to two, and even more than 2 are also preferable.

In a case that the number is odd number, the position of substantial edge nozzle is the position of medium of two nozzles that are arranged along the perpendicular direction adjacently.

About each embodiment before 4, each nozzle arrays may have nozzles that the positions are adjusted in perpendicular direction same as embodiment 5.

In these cases, the end part nozzle of claim is the substantial edge nozzle and the length of the nozzle array of claim is the length of the effective nozzle array.

What is claimed is:

1. A liquid ejecting device comprising:

a head unit having a plurality of nozzle arrays; and a movement mechanism that moves at least one of a target in which the liquid lands and the head unit in a movement direction that intersects with a direction of nozzle arrangement of each of the nozzle arrays, wherein the plurality of nozzle arrays has a set of n nozzle arrays including a first nozzle array and at least one second nozzle array that ejects a liquid of a same type as that of the first nozzle array and is disposed in a position deviated from the first nozzle array in the movement direction and in an intersection direction that intersects with the movement direction, and wherein the second nozzle array is in a position deviated from the first nozzle array in the intersection direction such that a center of the second nozzle array is apart from a center of the first nozzle array by a distance determined by 1/n of the length of the first nozzle array.

2. A liquid ejecting device comprising:

a head unit having a plurality of nozzle arrays; and a movement mechanism that moves at least one of a target in which the liquid lands and the head unit in a movement direction that intersects with a direction of nozzle arrangement of each of the nozzle arrays, wherein the plurality of nozzle arrays has a set of n nozzle arrays including a first nozzle array and at least one second nozzle array that ejects a liquid of a same type as that of the first nozzle array and is disposed in a position deviated from the first nozzle array in the movement direction and in an intersection direction that intersects with the movement direction such that an end part of the second nozzle array is disposed between one end of the first nozzle array and the other end of the first nozzle array, and wherein the second nozzle array is in a position deviated from the first nozzle array in the intersection direction such that the end part of the second nozzle array is apart from a corresponding end part of the first nozzle array by a distance determined by 1/n of the length of the first nozzle array.

3. A liquid ejecting device comprising:

a head unit having a first nozzle array and a second nozzle array that ejects a liquid of a same type as that of the first nozzle array; and a movement mechanism that moves at least one of a target in which the liquid lands and the head unit in a movement direction that intersects with a direction of nozzle arrangement of each of the nozzle arrays, wherein the second nozzle array is disposed in a position deviated from the first nozzle array in the movement direction and is disposed in a position deviated from the first nozzle array in an intersection direction, which intersects with the movement direction, such that a center of the second nozzle array is apart from a center of the first nozzle array by a distance of a half of the length of the first nozzle array in the intersection direction.

4. A liquid ejecting device comprising:

a head unit having a first nozzle array and a second nozzle array that ejects a liquid of a same type as that of the first nozzle array; and a movement mechanism that moves at least one of a target in which the liquid lands and the head unit in a movement direction that intersects with a direction of nozzle arrangement of each of the nozzle arrays, wherein the second nozzle array is disposed in a position deviated from the first nozzle array in the movement direction and is disposed in a position deviated from the first nozzle array in the direction of nozzle arrangement such that an end part of the second nozzle array is located in a center part of the first nozzle array in the direction of nozzle arrangement that intersects with the movement direction.

5. The liquid ejecting device according to claim 4, wherein a plurality of sets including the first nozzle array and the second nozzle array are arranged in the movement direction and ejects liquids of different types.

6. The liquid ejecting device according to claim 4, wherein the first nozzle array includes a plurality of first nozzles that are disposed in the direction of arrangement at a predetermined nozzle pitch, and wherein the second nozzle array includes a plurality of second nozzles that are disposed in the direction of arrangement at a predetermined nozzle pitch such that a position of the second nozzle array is located between the first nozzles that are adjacent in the direction of nozzle arrangement.

7. The liquid ejecting device according to claim 4, wherein the first nozzle array includes a plurality of first nozzles that are disposed in the direction of nozzle arrangement at a predetermined nozzle pitch, and wherein the second nozzle array includes second nozzles located in positions that are adjusted to positions of the first nozzles in the intersection direction.

8. The liquid ejecting device according to claim 4, further comprising a liquid receiving member that receives a liquid that does not land in the target at a time when the liquid is ejected toward the target.

9. The liquid ejecting device according to claim 4, wherein the head unit is installed to an installation member to be fixed to a predetermined position, and wherein the movement mechanism moves the target in the movement direction.

10. The liquid ejecting device according to claim 4, further comprising:

a transport mechanism that transports the target in a transport direction that intersects with the movement direction; and a controller that controls the head unit, the movement mechanism, and the transport mechanism, wherein the movement mechanism moves the head unit in the movement direction, and wherein the controller performs a movement and ejection operation for ejecting the liquid from the nozzles with the head unit moved in the movement direction and a transport operation for transporting the target in the transport direction by a unit amount transport that is defined within a range in which the liquid can be ejected from the nozzles.

* * * * *